US011931660B2

(12) United States Patent
Takebayashi

(10) Patent No.: US 11,931,660 B2
(45) Date of Patent: Mar. 19, 2024

(54) WISDOM RING PUZZLE

(71) Applicant: i Subaru Co., Ltd., Joetsu (JP)

(72) Inventor: Koji Takebayashi, Joetsu (JP)

(73) Assignee: i Subaru Co., Ltd., Joetsu (JP)

( * ) Notice: Subject to any disclaimer, the term of this patent is extended or adjusted under 35 U.S.C. 154(b) by 0 days.

(21) Appl. No.: 17/971,267

(22) Filed: Oct. 21, 2022

(65) Prior Publication Data

US 2023/0135937 A1 May 4, 2023

(30) Foreign Application Priority Data

Oct. 29, 2021 (JP) ..... 2021-178353

(51) Int. Cl.
*A63F 9/08* (2006.01)

(52) U.S. Cl.
CPC ..... *A63F 9/0876* (2013.01)

(58) Field of Classification Search
CPC ..... A63F 9/0876
USPC ..... D21/482
See application file for complete search history.

(56) References Cited

U.S. PATENT DOCUMENTS 3,198,524 A * 8/1965 Ringstad ..... A63F 9/0876 273/158
D271,505 S * 11/1983 Honeycutt ..... D21/482
4,957,292 A * 9/1990 Ushiyama ..... A63F 9/0876 273/159
2020/0330854 A1* 10/2020 Takebayashi ..... A63F 9/0876
2023/0141918 A1* 5/2023 Takebayashi ..... A63F 9/0876 273/159

FOREIGN PATENT DOCUMENTS

DE 9318115 U1 * 3/1994
DE 29605244 U1 * 5/1996 ..... A63F 9/0876
JP H2-283392 A 11/1990
JP 6112956 B2 4/2017
JP 6546364 B1 7/2019

* cited by examiner

*Primary Examiner* — Steven B Wong

(74) *Attorney, Agent, or Firm* — HAUPTMAN HAM, LLP

(57) ABSTRACT

A wisdom ring puzzle includes: a stage; a first ring unit positioned in a first direction with respect to the stage; a second ring unit positioned in the first direction with respect to the first ring unit; a first pole and a second pole connected to the second ring unit and connected to the stage through the inner side of the first ring unit. The first pole is connected to the first ring unit, extends in the first direction from the first ring unit, turns and extends in a second direction opposite to the first direction, is connected to the stage passing through the inner side of the first ring unit, and passes through the inner side of the second ring unit at a side of the first direction of the first ring unit.

7 Claims, 27 Drawing Sheets

WISDOM RING PUZZLE

CROSS REFERENCE TO RELATED APPLICATIONS

This application claims the benefit of priority to Japanese Patent Application No. 2021-178353, filed on Oct. 29, 2021, the entire contents of which are incorporated herein by reference.

FIELD

An embodiment of the present invention relates to a wisdom ring puzzle. More specifically, an embodiment of the present invention relates to a wisdom ring puzzle having a three-dimensional structure including a pole and a ring member which can be enjoyed using a looped lace.

BACKGROUND

As represented by the Chinese ring, there is known a wisdom ring puzzle composed of a rod-shaped pole, a ring member arranged at a tip of the pole, and a looped lace. In recent years, a wisdom ring puzzle composed of a combination of a pole and a ring member using the Chinese ring as a prototype has been proposed (U.S. Pat. No. 6,112,956 and Japanese laid-open patent publication No. H2-283392). Further, U.S. Pat. No. 6,546,364 is proposed as a wisdom ring puzzle having a different structure from that of the Chinese ring. The wisdom ring puzzle according to U.S. Pat. No. 6,546,364 is a puzzle having a three-dimensional structure and uses a looped lace.

The wisdom ring puzzle described in U.S. Pat. No. 6,112,956 and Japanese laid-open patent publication No. H2-283392 is complicated to solve, but there are many repetitions of simple mechanical operations, so that there are few stimuli to the logical thinking and imagination of a player. Therefore, there is a problem in that the player cannot have a contiguous interest and motivation to create a solution for these wisdom ring puzzles.

SUMMARY

A wisdom ring puzzle according to an embodiment includes: a stage; a first ring unit positioned in a first direction with respect to the stage; a second ring unit positioned in the first direction with respect to the first ring unit; a first pole; and a second pole connected to the second ring unit and connected to the stage through the inner side of the first ring unit. The first pole is connected to the first ring unit, extends in the first direction from the first ring unit, turns and extends in a second direction opposite to the first direction, is connected to the stage passing through the inner side of the first ring unit, and passes through the inner side of the second ring unit at a side of the first direction of the first ring unit.

The second pole may extend toward the stage from an end portion of the second ring unit in the second direction. The second pole may be connected to the stage.

The wisdom ring puzzle may further include: a third ring unit positioned between the stage and the first ring unit; and a third pole connected to the third ring unit and connected to the stage. The first pole may be connected to the stage through the inner side of the third ring unit.

The stage may include a stage upper surface, the first pole, the second pole, and the third pole being connected to the stage upper surface. The first ring unit may be arranged on a first virtual plane. The second ring unit may be arranged on a second virtual plane. The third ring unit may be arranged on a third virtual plane. An angle formed by the stage upper surface and the first virtual plane may be smaller than an angle formed by the stage upper surface and the second virtual plane. An angle formed by the stage upper surface and the third virtual plane may be smaller than an angle formed by the stage upper surface and the second virtual plane.

The wisdom ring puzzle may further include: a third ring unit positioned in the first direction with respect to the first ring unit; a fourth ring unit positioned in the first direction with respect to the third ring unit; a third pole; and a fourth pole connected to the fourth ring unit and connected to the stage through the inner side of the third ring unit. The third pole may be connected to the third ring unit, may extend in the first direction from the third ring unit, may turn and extend in the second direction, and may pass through the inner side of the third ring unit and the inner side of the first ring unit. The first pole may pass through the inner side of the second ring unit. The third pole may pass through inner side of the fourth ring unit.

The stage may include a stage upper surface, the first pole, the second pole, and the third pole being connected to the stage upper surface. The first ring unit may be arranged on a first virtual plane. The second ring unit may be arranged on a second virtual plane. The third ring unit may be arranged on a third virtual plane. The fourth ring unit may be arranged on a fourth virtual plane. An angle formed by the stage upper surface and the first virtual plane may be smaller than an angle formed by the stage upper surface and the second virtual plane. An angle formed by the stage upper surface and the third virtual plane may be smaller than an angle formed by the stage upper surface and the second virtual plane. An angle formed by the stage upper surface and the first virtual plane may be smaller than an angle formed by the stage upper surface and the fourth virtual plane. An angle formed by the stage upper surface and the third virtual plane may be smaller than an angle formed by the stage upper surface and the fourth virtual plane.

The wisdom ring puzzle may further include: a third ring unit positioned in the first direction with respect to the first ring unit; a fourth ring unit positioned in the first direction with respect to the third ring unit; a third pole; and a fourth pole. The third pole may be connected to the third ring unit, may extend in the first direction from the third ring unit, may turn and extend in the second direction, and may pass through the inner side of the third ring unit. The fourth pole may be connected to the fourth ring unit, may extend in the first direction from the fourth ring unit, may turn and extend in the second direction, and may be connected to the stage through the inner side of the third ring unit and the inner side of the first ring unit. The first pole may pass through the inner side of the second ring unit. The third pole may pass through the inner side of the fourth ring unit.

The stage may include a stage upper surface, the first pole, the second pole, and the third pole being connected to the stage upper surface. The first ring unit may be arranged on a first virtual plane. The second ring unit may be arranged on a second virtual plane. The third ring unit may be arranged on a third virtual plane. The fourth ring unit may be arranged on a fourth virtual plane. An angle formed by the stage upper surface and the first virtual plane may be smaller than an angle formed by the stage upper surface and the second virtual plane. An angle formed by the stage upper surface and the third virtual plane may be smaller than an angle formed by the stage upper surface and the second virtual plane. An angle formed by the stage upper surface and the first virtual plane may be smaller than an angle formed by the stage upper surface and the fourth virtual plane. An angle formed by the stage upper surface and the third virtual plane may be smaller than an angle formed by the stage upper surface and the fourth virtual plane.

The second pole may extend in the first direction from an end portion of the second ring unit in the first direction, may turn and extend in the second direction, and may be connected to the stage through the inner side of the first ring unit.

The wisdom ring puzzle may further include: a third ring unit positioned between the stage and the first ring unit; and a third pole connected to the third ring unit and connected to the stage. The second pole may be connected to the stage through the inner side of the third ring unit.

The stage may include a stage upper surface, the first pole, the second pole, and the third pole being connected to the stage upper surface. The first ring unit may be arranged on a first virtual plane. The second ring unit may be arranged on a second virtual plane. The third ring unit may be arranged on a third virtual plane. An angle formed by the stage upper surface and the first virtual plane may be smaller than an angle formed by the stage upper surface and the second virtual plane. An angle formed by the stage upper surface and the third virtual plane may be smaller than an angle formed by the stage upper surface and the second virtual plane.

A wisdom ring puzzle according to an embodiment includes: a stage; a first ring unit positioned in a first direction with respect to the stage; a second ring unit positioned in the first direction with respect to the first ring unit; a first pole; a second pole; and a third pole. The first pole is connected to the first ring unit, extends in the first direction from the first ring unit, turns and extends in a second direction opposite to the first direction, is connected to the stage, and passes through the inner side of the second ring unit. The second pole is connected to the second ring unit, extends in the first direction from the second ring unit, turns and extends in the second direction, and is connected to the stage. The third pole is connected to the stage, extends in the first direction from the stage, turns and extends in the second direction, and passes through the inner side of the first ring unit. A gap is provided between an end portion of a part of the third pole in the second direction and the stage. The part extends in the second direction.

A position where the first pole is connected to the stage may be arranged between a position where the second pole is connected to the stage and the second ring unit in a plan view. The second ring unit may be arranged between a position where the first pole is connected to the stage and the first ring unit in a plan view.

The first ring unit may be arranged between a position where the second pole is connected to the stage and the second ring unit in a plan view. The second ring unit may be arranged between a position where the first pole is connected to the stage and the first ring unit in a plan view.

A wisdom ring puzzle according to an embodiment includes: a stage; a first ring unit positioned in a first direction with respect to the stage; a second ring unit positioned in the first direction with respect to the first ring unit; a first pole; a second pole; and a third pole. The first pole is connected to the first ring unit, extends in the first direction from the first ring unit, turns and extends in a second direction opposite to the first direction, is connected to the stage crossing over the outer side of the first ring unit, and passes through the inner side of the second ring unit at a side of the first direction of the first ring unit. The second pole is connected to the second ring unit, extends in the first direction from the second ring unit, turns and extends in the second direction, and is connected to the stage. The third pole is connected to the stage, extends in the first direction from the stage, turns and extends in the second direction, and passes through the inner side of the first ring unit. A gap is provided between an end portion of a part of the third pole in the second direction and the stage, the part extending in the second direction.

A position where the first pole is connected to the stage may be arranged between a position where the second pole is connected to the stage and the second ring unit in a plan view. The second ring unit may be arranged between a position where the first ring unit is connected to the first pole and a position where the first pole is connected to the stage in a plan view.

A position where the first ring unit is connected to the first pole may be arranged between a position where the second pole is connected to the stage and the second ring unit in a plan view. The second ring unit may be arranged between a position where the first ring unit is connected to the first pole and a position where the first pole is connected to the stage in a plan view.

DESCRIPTION OF EMBODIMENTS

Figure 1A:
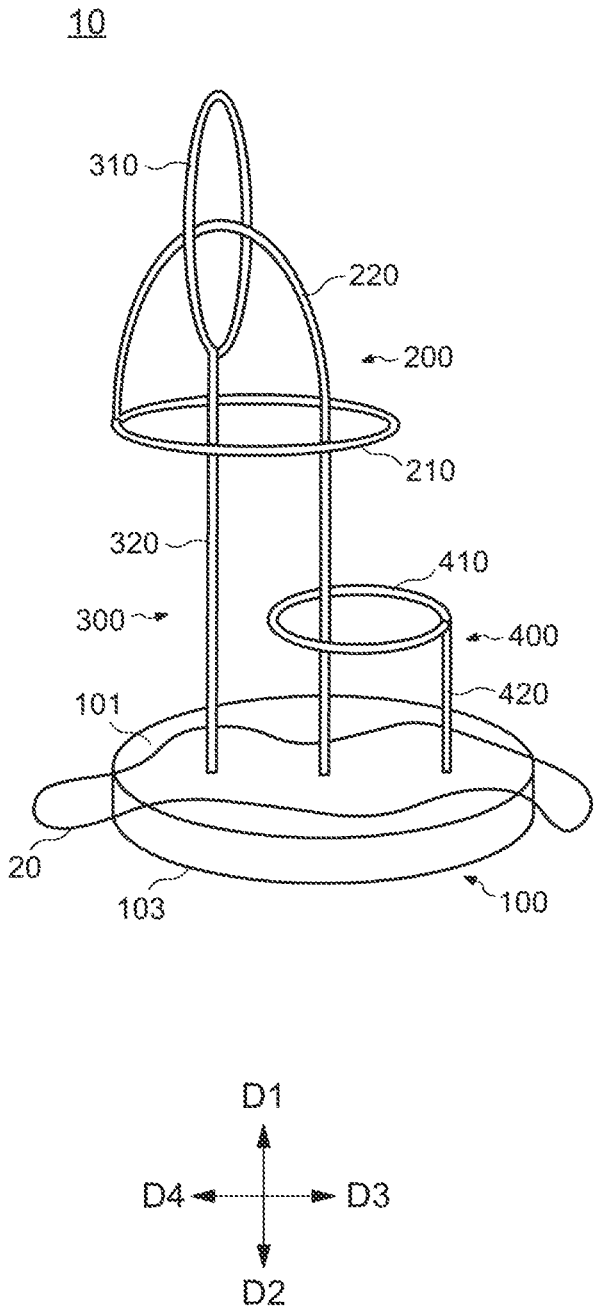
FIG. 1A is a diagram showing a structure of a wisdom ring puzzle according to an embodiment of the present invention.

Hereinafter, a wisdom ring puzzle according to the present embodiment will be described in detail with reference to the drawings. In the following description, elements having substantially the same functions and configurations are denoted by the same symbols and will be described redundantly only when necessary. The following embodiments exemplifies a device and method for embodying the technical idea of this embodiment. The technical idea of the embodiment is not to specify the material, shape, structure, arrangement, or the like of the constituent parts as follows. Various modifications may be made to the technical idea of the embodiment in addition to the scope of the claims.

In each embodiment of the present invention, direction from a stage 100 toward each structure body (e.g., a first structure body 200) is referred to as upper direction or first direction. On the contrary, direction from each structure toward the stage 100 is referred to as lower direction or second direction. As described above, for convenience of explanation, although the phrase "upper" or "lower" is used for explanation, for example, the stage 100 and the first structure body 200 may be arranged so that the vertical relationshipship is opposite to the drawing. In the following description, for example, the expression "the first structure body 200 above the stage 100" merely describes the vertical relationshipship between the stage 100 and the first structure body 200 as described above, and other members may be arranged between the stage 100 and the first structure body 200. The upper direction or lower direction means the vertical relationshipship in a vertical direction in the plurality of members, and the expression "the first structure body 200 above the stage 100" indicates the positional relationshipship in which the stage 100 and the first structure body 200 do not overlap in a plan view. On the other hand, the expression "the first structure body 200 vertically above the stage 100" indicates the positional relationshipship in which the stage 100 and the first structure body 200 overlap in a plan view.

In the present specification, expressions "α includes A, B, or C," "a includes any of A, B, and C," and "α includes one selected from a group consisting of A, B, and C," do not exclude the case where α includes a plurality of combinations of A to C unless otherwise specified. Furthermore, these expressions do not exclude the case where α includes other elements.

An object of an embodiment of the present invention is to provide a wisdom ring puzzle capable of sustaining the interest and motivation of a player to create a solution.

1. First Embodiment

Figure 1B:
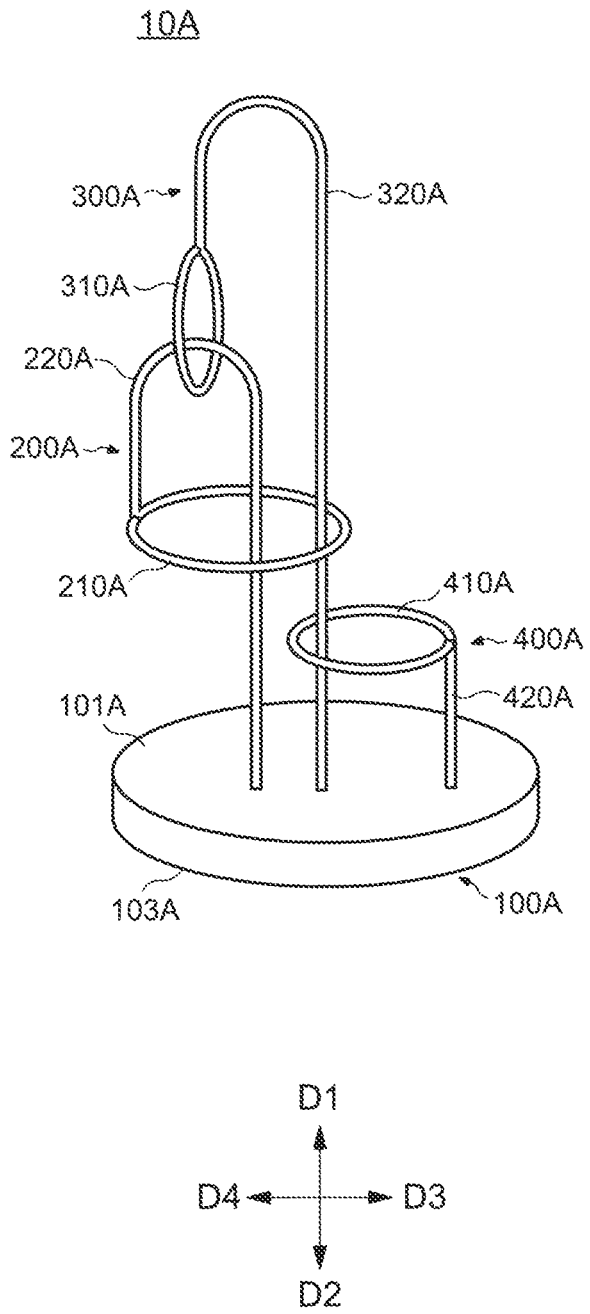
FIG. 1B is a diagram showing a structure of a wisdom ring puzzle according to an embodiment of the present invention.

Wisdom ring puzzles 10 and 10A according to a first embodiment of the present invention will be described with reference to FIG. 1A to FIG. 5. FIG. 1A and FIG. 1B are diagrams illustrating structures of wisdom ring puzzles according to embodiments of the present invention. FIG. 2 to FIG. 5 are diagrams showing a method of solving a wisdom ring puzzle according to an embodiment of the present invention. As will be described later, the wisdom ring puzzles 10 and 10A are puzzles using laces 20 and 20A. The player enjoys the wisdom ring puzzles 10 and 10A by entangling the laces 20 and 20A with poles (for example, third poles 420 and 420A) arranged on the wisdom ring puzzles 10 and 10A or removing the laces 20 and 20A from the poles.

[1-1. Structure of Wisdom Ring Puzzle 10]

As shown in FIG. 1A, the wisdom ring puzzle 10 includes the stage 100, the first structure body 200, a second structure body 300, and a third structure body 400. The lace 20 is used to play with the wisdom ring puzzle 10. In the present embodiment, although the lace 20 has a closed loop shape, it is not limited to this configuration.

The stage 100 includes an upper surface 101 and a bottom surface 103. The first structure body 200, the second structure body 300, and the third structure body 400 are connected to the upper surface 101. The bottom surface 103 is a surface that can be placed on a flat surface such as a table. In the present embodiment, the stage 100 has a circular flat plate shape in a plan view. However, the shape of the stage 100 in a plan view is not limited to a circular shape. For example, the shape of the stage 100 in a plan view may be a polygon such as a triangle or a quadrangle or may be an ellipse or a looped curved shape. In addition, the upper surface 101 and the bottom surface 103 are not limited to a flat surface and may be a structure in which unevenness is arranged.

The first structure body 200 includes a first ring unit 210 and a first pole 220. The first ring unit 210 is arranged on a virtual plane substantially parallel to the upper surface 101. The first pole 220 is connected to the first ring unit 210 and has an upwardly convex U-shape. In other words, the first pole 220 is connected to the first ring unit 210, extends in direction D1 from a connection part with the first ring unit 210, is turned, and extends in direction D2. The first pole 220 extending in the direction D2 passes through the inner side of the first ring unit 210 and reaches the stage 100. The first pole 220 is connected to the first ring unit 210 at an end portion of the first ring unit 210 in direction D4 in a plan view. In a plan view, the first pole 220 extends in direction D3 from the connection part with the first ring unit 210 and reaches the stage 100 at the inner side of the first ring unit 210. However, a position where the first pole 220 is connected to the first ring unit 210 is not limited to the above-described configuration.

The second structure body 300 includes a second ring unit 310 and a second pole 320. The second ring unit 310 is arranged on a virtual plane substantially orthogonal to the upper surface 101. The second pole 320 extends from an end portion of the second ring unit 310 in the direction D2 toward the stage 100 and is connected to the stage 100. However, a position where the second pole 320 is connected to the second ring unit 310 is not limited to the above-described configuration.

The third structure body 400 includes a third ring unit 410 and the third pole 420. The third ring unit 410 is arranged on a virtual plane substantially parallel to the upper surface 101. The third pole 420 is connected to the third ring unit 410 at an end portion of the third ring unit 410 in the direction D3. The third pole 420 extends from a connection part with the third ring unit 410 toward the direction D2 and is connected to the stage 100. However, a position where the third pole 420 is connected to the third ring unit 410 is not limited to the above-described configuration.

The first ring unit 210 is positioned in the direction D1 with respect to the stage 100. The second ring unit 310 is positioned in the direction D1 with respect to the first ring unit 210. The third ring unit 410 is positioned in the direction D1 with respect to the stage 100 and the direction D2 with respect to the first ring unit 210. As described above, in the present embodiment, the virtual plane (first virtual plane) on which the first ring unit 210 is arranged and the virtual plane (third virtual plane) on which the third ring unit 410 is arranged are substantially parallel to the upper surface 101, and the virtual plane (second virtual plane) on which the second ring unit 310 is arranged is substantially orthogonal to the upper surface 101. However, the present invention is not limited to the above configuration. For example, the angle formed by the upper surface 101 and the first virtual plane and the angle formed by the upper surface 101 and the third virtual plane may be smaller than the angle formed between the upper surface 101 and the second virtual plane.

In the present embodiment, although the configuration in which all of the second ring units 310 are positioned in the direction D1 with respect to the first ring unit 210 is exemplified, the configuration is not limited to this configuration. For example, a part of the second ring unit 310 may be positioned in the direction D1 with respect to the first ring unit 210. That is, when viewed from the side, the first ring unit 210 and the second ring unit 310 may intersect.

The first pole 220 extends in the direction D1 from the connection part with the first ring unit 210, passes through the inner side of the second ring unit 310, and then passes through the inner side of the first ring unit 210 in the direction D2. Further, the first pole 220 passes through the inner side of the first ring unit 210 in the direction D2, passes through the inner side of the third ring unit 410, and is connected to the stage 100. In a plan view, the first pole 220 extends from the connection part with the first ring unit 210 toward the third pole 420 (the direction D3), passes through the inner side of the second ring unit 310, and is connected to the stage 100 at a position where the first ring unit 210 and the third ring unit 410 overlap. The second pole 320 extends from the second ring unit 310 in the direction D2, passes through the inner side of the first ring unit 210, and is connected to the stage 100. The third pole 420 extends from the third ring unit 410 in the direction D2 and is connected to the stage 100.

In the present embodiment, the first ring unit 210, the second ring unit 310, and the third ring unit 410 are contiguous with the first pole 220, the second pole 320, and the third pole 420, respectively. For example, the first ring unit 210 is formed such that the first pole 220 is bent and forms a ring shape on the first virtual plane. Therefore, in the wisdom ring puzzle 10 of the present embodiment, each ring unit is not a completely closed loop shape without a gap but may be a closed loop shape without a gap. Also, even when a gap is arranged in each ring unit in the present embodiment, a width of the gap is such that the lace 20 does not pass therethrough. In addition, in the present embodiment, the first ring unit 210 and the first pole 220 are contiguous rod-shaped members. Similarly, the second ring unit 310 and the second pole 320 are contiguous rod-shaped members. Similarly, the third ring unit 410 and the third pole 420 are contiguous rod-shaped members. However, the ring unit and the pole may be separate members, and they may be joined to each other by welding or the like.

[1-2. Structure of Wisdom Ring Puzzle 10A]

As shown in FIG. 1B, a wisdom ring puzzle 10A includes a stage 100A, a first structure body 200A, a second structure body 300A, and a third structure body 400A. Although the wisdom ring puzzle 10A shown in FIG. 1B is similar to the wisdom ring puzzle 10 shown in FIG. 1A, the first structure body 200A and the second structure body 300A are different from the first structure body 200 and the second structure body 300 of the wisdom ring puzzle 10. In the following description, differences between the wisdom ring puzzle 10 and the wisdom ring puzzle 10A will be mainly explained. In the following description, in the case of describing the same configuration as the wisdom ring puzzle 10, the description may be omitted by adding the letter "A" after the symbols shown in FIG. 1A.

A second pole 320A extends in the direction D1 from an end portion of the second ring unit 310A in the direction D1, turns and extends in the direction D2. The second pole 320A extending in the direction D2 passes through the inner side of each of a first ring unit 210A and a third ring unit 410A and reaches the stage 100A. In a plan view, the second pole 320A extends from a connection part with the second ring unit 310A toward a third pole 420A (the direction D3) and is connected to the stage 100A at a position crossing over a first pole 220A and at a position where the first ring unit 210A and the third ring unit 410A overlap.

Although the second ring unit 310 is positioned at the uppermost portion in the wisdom ring puzzle 10 shown in FIG. 1A, the second pole 320A is positioned at the uppermost portion in the wisdom ring puzzle 10A shown in FIG. 1B. Further, the wisdom ring puzzle 10 is different from the wisdom ring puzzle 10A in that the first pole 220 passes through each of the inner sides of the first ring unit 210 and the third ring unit 410 in the wisdom ring puzzle 10 while the second pole 320A passes through each of the inner sides of the first ring unit 210A and the third ring unit 410A in the wisdom ring puzzle 10A.

In FIG. 1A and FIG. 1B, although the configuration in which the first poles 220 and 220A pass through the inner side of the second ring units 31 and 310A in the vicinity of the uppermost portion of the first poles 220 and 220A is exemplified, the configuration is not limited to this. The first poles 220 and 210A may pass through the inner side of the second ring units 310 and 310A from a connection part between the first ring units 210 and 210A and the first poles 220 and 220A to the position where the first poles 220 and 220A pass through the inner side of the first ring units 210 and 210A in the direction D2. Therefore, for example, the second virtual plane on which the second ring units 310 and 310A are arranged may be parallel to the first virtual plane on which the first ring units 210 and 210A are arranged.

[1-3. Method of Solving Wisdom Ring Puzzle 10 (Part 1)]

A method 1000 of solving the wisdom ring puzzle 10 shown in FIG. 1A will be described with reference to FIG. 2. The lace 20 is used to play the wisdom ring puzzle 10. The player moves the lace 20 along the poles (the first pole 220 to the third pole 420) arranged on the first structure body 200 to the third structure body 400 and moves the lace 20 between the poles by passing it through the inner side of the ring units (the first ring unit 210 to the third ring unit 410) or crossing it over the outer side of the ring units. Then, in the present embodiment, the player aims for a state in which the lace 20 is entangled only with the third pole 420. That is, the wisdom ring puzzle 10 according to the present embodiment is a puzzle that aims at a state in which only the third pole 420 exists at the inner side of the lace 20.

Figure 2:
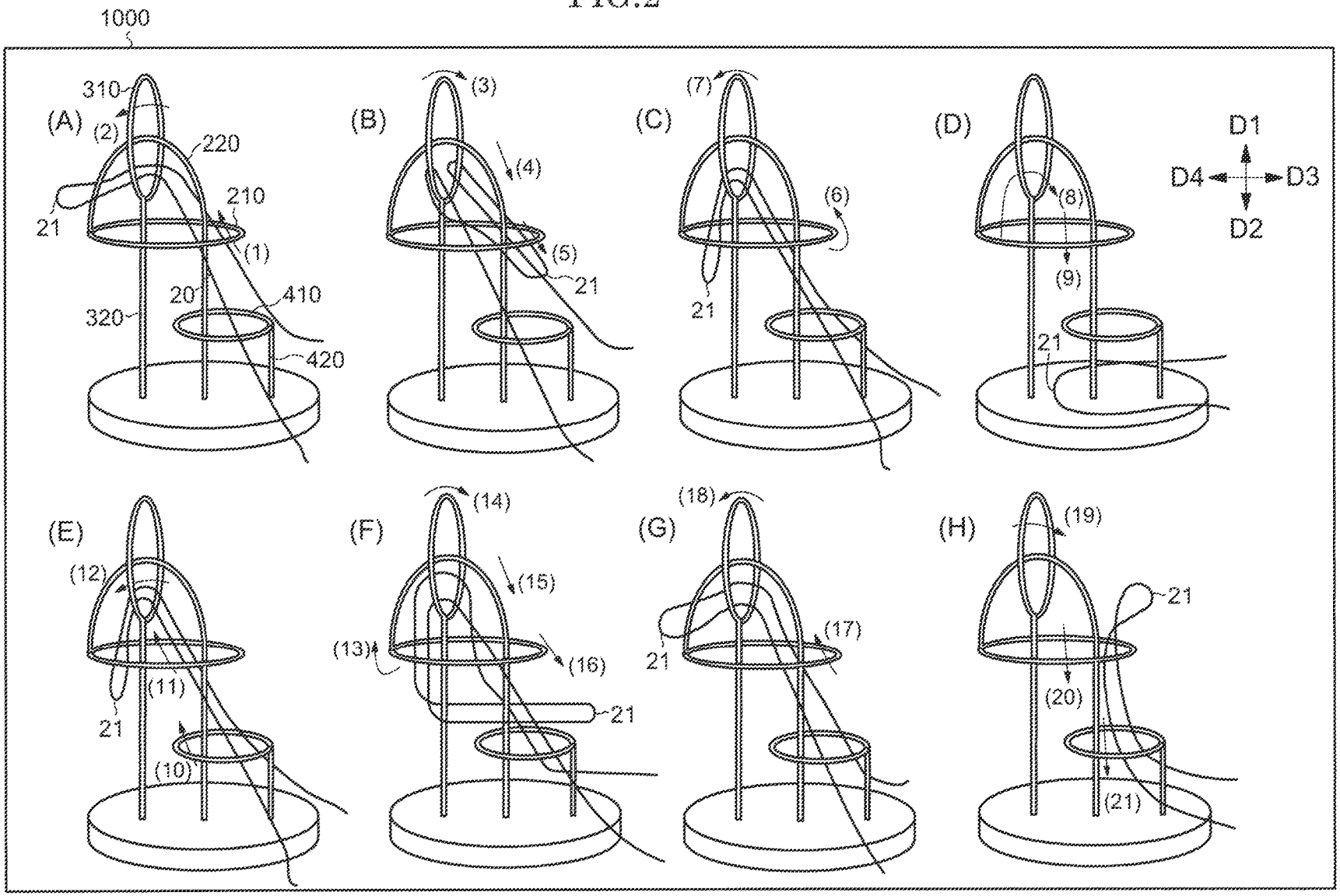
FIG. 2 is a diagram showing a method of solving a wisdom ring puzzle according to an embodiment of the present invention.

As shown in (A) of FIG. 2, a tip 21 of the lace 20 passes through the inner side of the first ring unit 210 in the direction D1 (1) and passes through the inner side of the second ring unit 310 in the direction D4 (2). In this case, the tip 21 moves along the first pole 220 and passes through the second ring unit 310 at the area in the direction D1 with respect to the first pole 220. In this state, the lace 20 does not pass through the inner side of the third ring unit 410. The lace 20 which passed through the inner side of the second ring unit 310 sandwiches the first pole 220.

As shown in (B) of FIG. 2, the tip 21 of the lace 20 moves upward along the first pole 220, crosses over the second ring unit 310 in the direction D3 (3), moves along the first pole 220 in the direction D2 (4), and passes through the inner side of the first ring unit 210 in the direction D2 (5).

As shown in (C) of FIG. 2, the tip 21 of the lace 20 crosses over the outer side (direction D3 side) of the first ring unit 210 in the direction D1 (6) and crosses over the second ring unit 310 in the direction D4 (7). That is, the lace 20 hangs on the inner side of the second ring unit 310 and hangs down in the direction D2. In this state, the lace 20 sandwiches the first pole 220. Also, the tip 21 of the lace 20 may pass through the inner side of the first ring unit 210. This is the difference between the state shown in (A) of FIG. 2 and the state shown in (C) of FIG. 2.

As shown in (D) of FIG. 2, the tip 21 of the lace 20 passes through the inner side of the second ring unit 310 in the direction D3 (8), passes through the inner side of the first ring unit 210 in the direction D2 (9), moves in the direction D2 along the first pole 220, and crosses over the outer side (direction D4 side) of the third ring unit 410 in the direction D2. As a result, the lace 20 is in a state of being entangled with the first pole 220 and the third pole 420. In this state, the first pole 220 and the third pole 420 exist on the inner side of the lace 20.

As shown in (E) of FIG. 2, the tip 21 of the lace 20 passes through the inner side of the third ring unit 410 in the direction D1 (10), passes through the inner side of the first ring unit 210 in the direction D1 (11), and passes through the inner side of the second ring unit 310 in the direction D4 (12). That is, the lace 20 hangs on the inner side of the second ring unit 310 and hangs down in the direction D2 so as to pass through the inner side of the first ring unit 210. In this state, the lace 20 sandwiches the first pole 220 and the third pole 420. A point that the lace 20 passes through the inner side of the third ring unit 410 is a difference between the state shown in (C) of FIG. 2 and the state shown in (E) of FIG. 2.

As shown in (F) of FIG. 2, from a state in which the tip 21 of the lace 20 passes through the inner side of the first ring unit 210 in the direction D2, while maintaining a state in which the lace 20 sandwiches the first ring unit 210, the tip 21 moves in the direction D1, crosses over the outer side (direction D4 side) of the first ring unit 210 in the direction D1 (13), moves in the direction D1 along the first pole 220, crosses over the second ring unit 310 in the direction D3 (14), moves in the direction D2 along the first pole 220 (15), and crosses over the outer side (direction D3 side) of the first ring unit 210 in the direction D2 (16).

As shown in (G) of FIG. 2, the tip 21 of the lace 20 passes through the inner side of the first ring unit 210 in the direction D1 (17) and crosses over the second ring unit 310 in the direction D4 (18). The lace 20 crosses over the second ring unit 310 and sandwiches the first pole 220. The tip 21 is positioned further in the direction D4 with respect to the first pole 220 than the connection part between the first pole 220 and the first ring unit 210. This is the difference between the state shown in (E) of FIG. 2 and the state shown in (G) of FIG. 2.

As shown in (H) of FIG. 2, the tip 21 of the lace 20 passes through the inner side of the second ring unit 310 in the direction D3 (19), passes through the inner side of the first ring unit 210 in the direction D2 (20), and passes through the inner side of the third ring unit 410 in the direction D2 (21). As a result, the lace 20 is in a state of being entangled only with the third pole 420. In this state, only the third pole 420 exists at the inner side of the lace 20. That is, this state is a state in which the puzzle is solved.

[1-4. Method of Solving Wisdom Ring Puzzle 10 (Part 2)]

Another method 1000 of solving the wisdom ring puzzle 10 shown in FIG. 1A will be described with reference to FIG. 3. As shown in (A) of FIG. 3, the tip 21 of the lace 20 passes through the inner side of the third ring unit 410 in the direction D1 (1), passes through the inner side of the first ring unit 210 in the direction D1 (2), and passes through the inner side of the second ring unit 310 in the direction D4 (3). In this case, the tip 21 moves along the first pole 220 and passes through the second ring unit 310 at the area in the direction D1 with respect to the first pole 220. In this state, the lace 20 which passed through the inner side of the second ring unit 310 sandwiches the first pole 220.

Figure 3:
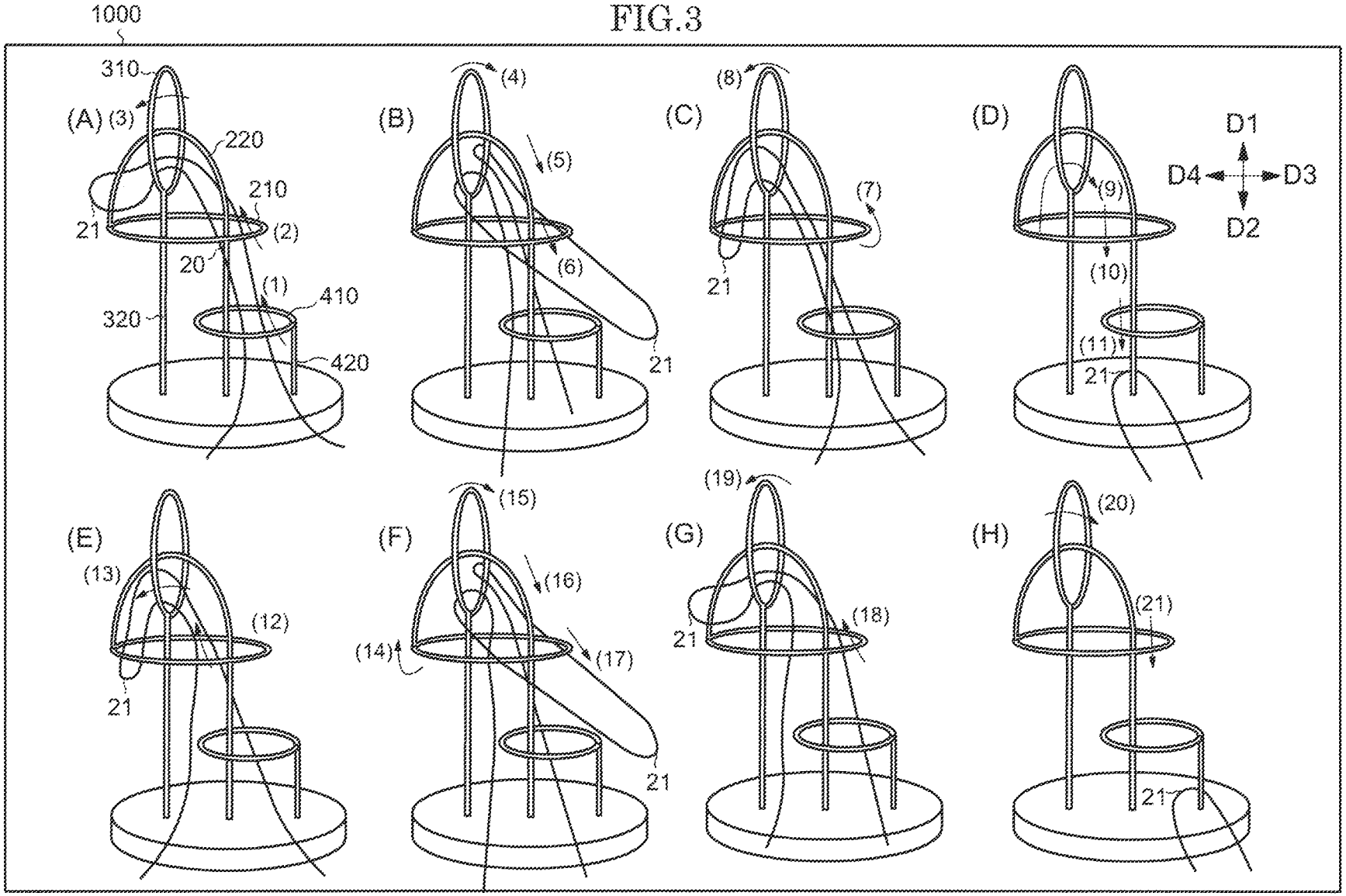
FIG. 3 is a diagram showing a method of solving a wisdom ring puzzle according to an embodiment of the present invention.

As shown in (B) of FIG. 3, the tip 21 of the lace 20 moves in the direction D1 along the first pole 220, crosses over the second ring unit 310 in the direction D3 (4), moves in the direction D2 along the first pole 220 (5), and passes through the inner side of the first ring unit 210 in the direction D2 (6).

As shown in (C) of FIG. 3, the tip 21 of the lace 20 crosses over the outer side (direction D3 side) of the first ring unit 210 in the direction D1 (7), and crosses over the second ring unit 310 in the direction D4 (8). That is, the lace 20 hangs on the inner side of the second ring unit 310 and hangs down in the direction D2. In this state, the lace 20 sandwiches the first pole 220. Also, the tip 21 of the lace 20 may pass through the inner side of the first ring unit 210. This is the difference between the state shown in (A) of FIG. 3 and the state shown in (C) of FIG. 3.

As shown in (D) of FIG. 3, the tip 21 of the lace 20 passes through the inner side of the second ring unit 310 in the direction D3 (9), passes through the inner side of the first ring unit 210 in the direction D2 (10), moves along the first pole 220 in the direction D2, and passes through the inner side of the third ring unit 410 in the direction D2 (11). As a result, the lace 20 is in a state of being entangled only with the first pole 220. In this state, only the first pole 220 exists at the inner side of the lace 20.

As shown in (E) of FIG. 3, the tip 21 of the lace 20 passes through the inner side of the first ring unit 210 in the direction D1 (12) and passes through the inner side of the second ring unit 310 in the direction D4 (13). In this case, the tip 21 passes through the first ring unit 210 at the area in the direction D4 with respect to the first pole 220. That is, the lace 20 hangs on the inner side of the second ring unit 310 and hangs down in the direction D2 so as to pass through the inner side of the first ring unit 210. In this state, the lace 20 sandwiches the first pole 220 at the side of the direction D2 of the third ring unit 410. In this state, a point that the lace 20 crosses over the outer side of the third ring unit 410 (does not pass through the inner side of the third ring unit 410) is a difference between the state shown in (C) of FIG. 3 and the state shown in (E) of FIG. 3.

As shown in (F) of FIG. 3, the tip 21 of the lace 20 crosses over the outer side (direction D2 side) of the first ring unit 210 in the direction D1 while maintaining a state in which the lace 20 sandwiches the first ring unit 210 (14), moves in the direction D1 along the first pole 220, crosses over the second ring unit 310 in the direction D3 (15), moves in the direction D2 along the first pole 220 (16), and crosses over the outer side (direction D3 side) of the first ring unit 210 in the direction D2 (17).

As shown in (G) of FIG. 3, the tip 21 of the lace 20 passes through the inner side of the first ring unit 210 in the direction D1 (18), and crosses over the second ring unit 310 in the direction D4 (19). The lace 20 which crossed over the second ring unit 310 sandwiches the first pole 220. The tip 21 is positioned further in the direction D4 with respect to the first pole 220 than the connection part between the first pole 220 and the first ring unit 210. This is the difference between the state shown in (E) of FIG. 3 and the state shown in (G) of FIG. 3.

As shown in (H) of FIG. 3, the tip 21 of the lace 20 passes through the inner side of the second ring unit 310 in the direction D3 (20), passes through the inner side of the first ring unit 210 in the direction D2 (21), and the lace 20 is reversed in the direction D3 to be entangled only with the third pole 420 (a state in which the puzzle is solved). In this state, only the third pole 420 exists at the inner side of the lace 20.

[1-5. Method of Solving Wisdom Ring Puzzle 10A (Part 1)]

A method 1000A of solving the wisdom ring puzzle 10A shown in FIG. 1B will be described with reference to FIG. 4. The wisdom ring puzzle 10A is a puzzle targeting a state in which a lace 20A is entangled only with the third pole 420A (a state in which only the third pole 420A exists at the inner side of the lace 20A) similar to the wisdom ring puzzle 10.

First, the lace 20A is arranged so that the first structure body 200A to a third structure body 400A are all positioned at the inner side of the lace 20A. That is, in a state where the lace 20A is placed on the stage 100A, the first pole 220A to the third pole 420A are sandwiched (surrounded) by the lace 20A. From that state, as shown in (A) of FIG. 4, a tip 21A of the lace 20A passes through the inner side of the first ring unit 210A in the direction D1 (1), passes through the inner side of the second ring unit 310A in the direction D4 (2), and passes through the inner side of the first ring unit 210A in the direction D2 (3). In this case, the tip 21A passes through the first ring unit 210A at the area in the direction D4 with respect to the first pole 220A and passes through the second ring unit 310A at the area in the direction D2 with respect to the first pole 220A.

Figure 4:
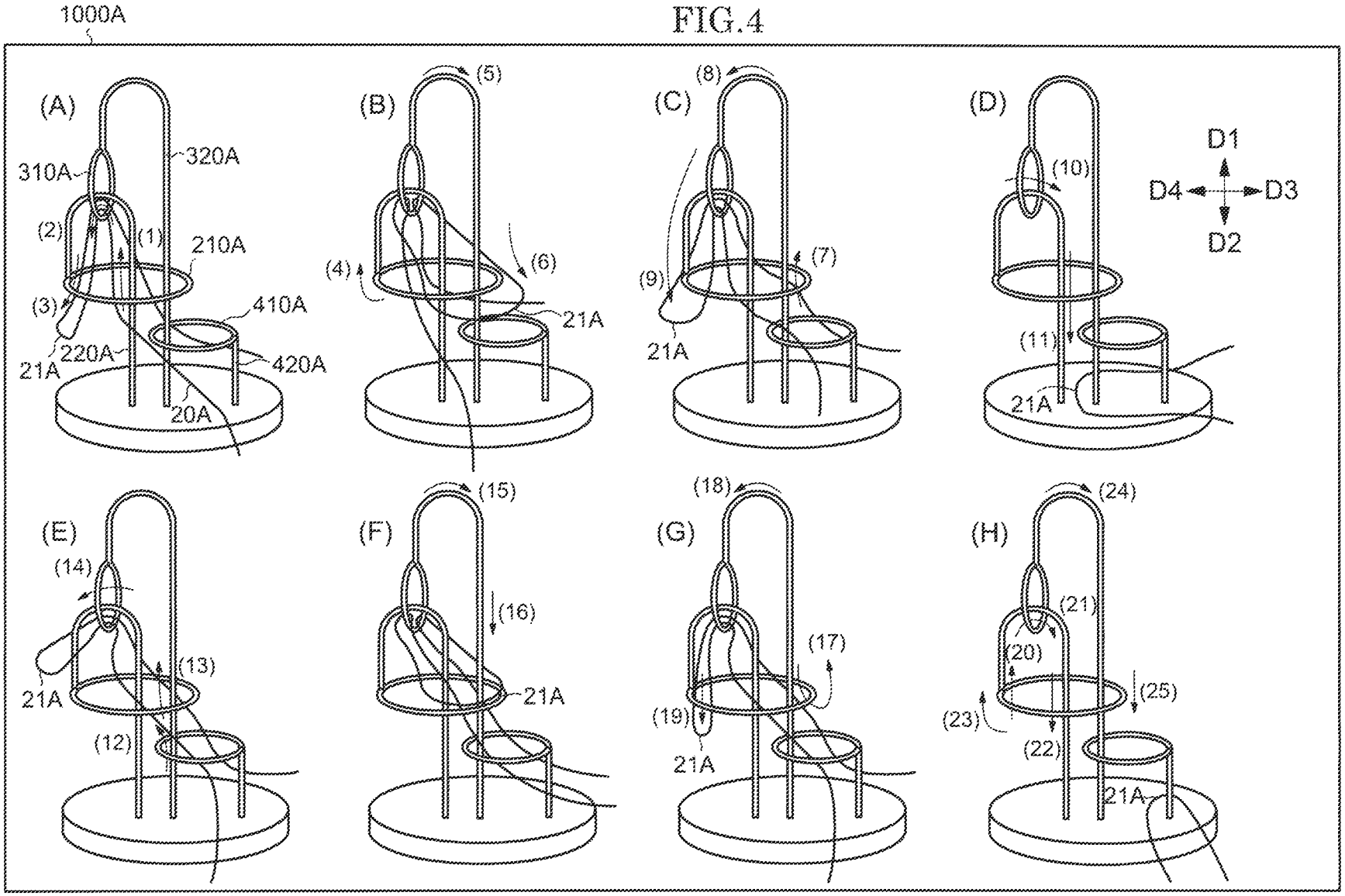
FIG. 4 is a diagram showing a method of solving a wisdom ring puzzle according to an embodiment of the present invention.

As shown in (B) of FIG. 4, the tip 21A of the lace 20A extending in the side of the direction D2 of the first ring unit 210A crosses over the outer side (direction D4 side) of the first ring unit in the direction D1 (4), moves in the direction D1 along the first pole 220A and the second pole 320A, and crosses over the uppermost portion of the second pole 320A in the direction D3 (5). Thereafter, the tip 21A moves in the direction D2 along the second pole 320A and crosses over the outer side (direction D3 side) of the first ring unit 210A in the direction D2 (6). In this state, the lace 20A in the vicinity of the tip 21A sandwiches the first pole 220A and the second pole 320A and is positioned at the outer side of the first ring unit 210A.

As shown in (C) of FIG. 4, the tip 21A of the lace 20A passes through the inner side of the first ring unit 210A in the direction D1 (7), crosses over the uppermost portion of the second pole 320A in the direction D4 (8), moves in the direction D2 along the second pole 320A and the first pole 220A, and crosses over the outer side (direction D4 side) of the first ring unit 210A in the direction D2 (9). In this state, the lace 20A in the vicinity of the tip 21A sandwiches the first pole 220A and the second pole 320A and is positioned at the outer side of the first ring unit 210A.

As shown in (D) of FIG. 4, the tip 21A of the lace 20A passes through the inner side of the second ring unit 310A in the direction D3 (10) and passes through the inner side of the first ring unit 210A in the direction D2 (11). As a result, the lace 20A is in a state of being entangled with the second pole 320A and the third pole 420A. In this state, the second pole 320A and the third pole 420A exist on the inner side of the lace 20A.

As shown in (E) of FIG. 4, the tip 21A of the lace 20A passes through the inner side of the third ring unit 410A in the direction D1 (12), passes through the inner side of the first ring unit 210A in the direction D1 (13), and passes through the inner side of the second ring unit 310A in the direction D4 (14). That is, the lace 20A hangs on the inner side of the second ring unit 310A and hangs down in the direction D2. In this state, the lace 20A sandwiches the first pole 220A, the second pole 320A, and the third pole 420A. As in (C) of FIG. 4, the lace 20A in the vicinity of the tip 21A is positioned at the outer side of the first ring unit 210A. In this state, a point that the lace 20A passes through the inner side of the third ring unit 410A is a difference between the state shown in (C) of FIG. 4 and the state shown in (E) of FIG. 4.

As shown in (F) of FIG. 4, the tip 21A of the lace 20A moves in the direction D1 along the first pole 220A and the second pole 320A and crosses over the uppermost portion of the second pole 320A in the direction D3 (15). Thereafter, the tip 21A moves in the direction D2 along the second pole 320A (16).

As shown in (G) of FIG. 4, the tip 21A of the lace 20A passes through the inner side of the first ring unit 210A (an area between the first ring unit 210A and the second pole 320A) in the direction D2 (17), turns and crosses over the outer side (direction D3 side) of the first ring unit 210A in the direction D1 (17). The tip 21A moves in the direction D1 along the second pole 320A, crosses over the uppermost portion of the second pole 320A in the direction D4 (18), moves in the direction D2 along the second pole 320A and the first pole 220A, and passes through the inner side of the first ring unit 210A in the direction D2 (19). That is, the lace 20A hangs on the inner side of the second ring unit 310A and hangs down in the direction D2 so as to pass through the inner side of the first ring unit 210A. In this state, the lace 20A sandwiches the first pole 220A, the second pole 320A, and the third pole 420A. In this state, a point that the lace 20A passes through the inner side of the first ring unit 210A is a difference between the state shown in (E) of FIG. 4 and the state shown in (G) of FIG. 4.

As shown in (H) of FIG. 4, the tip 21A of the lace 20A passes through the inner side of the first ring unit 210A in the direction D1 (20), moves in the direction D1 along the first pole 220A, passes through the second ring unit 310A in the direction D3 (21), moves in the direction D2 along the first pole 220A, and passes through the inner side of the first ring unit 210A in the direction D2 (22). Thereafter, the tip 21A crosses over the outer side (direction D4 side) of the first ring unit 210A in the direction D1 (23), moves in the direction D1 along the first pole 220A and the second pole 320A, and crosses over the uppermost portion of the second pole 320A in the direction D3 (24), moves in the direction D2 along the second pole 320A, and crosses over the outer side (direction D3 side) of the first ring unit 210A in the direction D2 (25), so that the lace 20A is in a state of being entangled only with the third pole 420A (a state in which the puzzle is solved). In this state, only the third pole 420A exists at the inner side of the lace 20A.

[1-6. Method of Solving Wisdom Ring Puzzle 10A (Part 2)]

Another method 1000A of solving the wisdom ring puzzle 10 shown in FIG. 1B will be described with reference to FIG. 5. As shown in (A) of FIG. 5, the tip 21A of the lace 20A passes through the inner side of the third ring unit 410A in the direction D1 (1), passes through the inner side of the first ring unit 210A in the direction D1 (2), and passes through the inner side of the second ring unit 310A in the direction D4 (3). In this state, the lace 20A which passed through the inner side of the second ring unit 310A sandwiches the first pole 220A.

Figure 5:
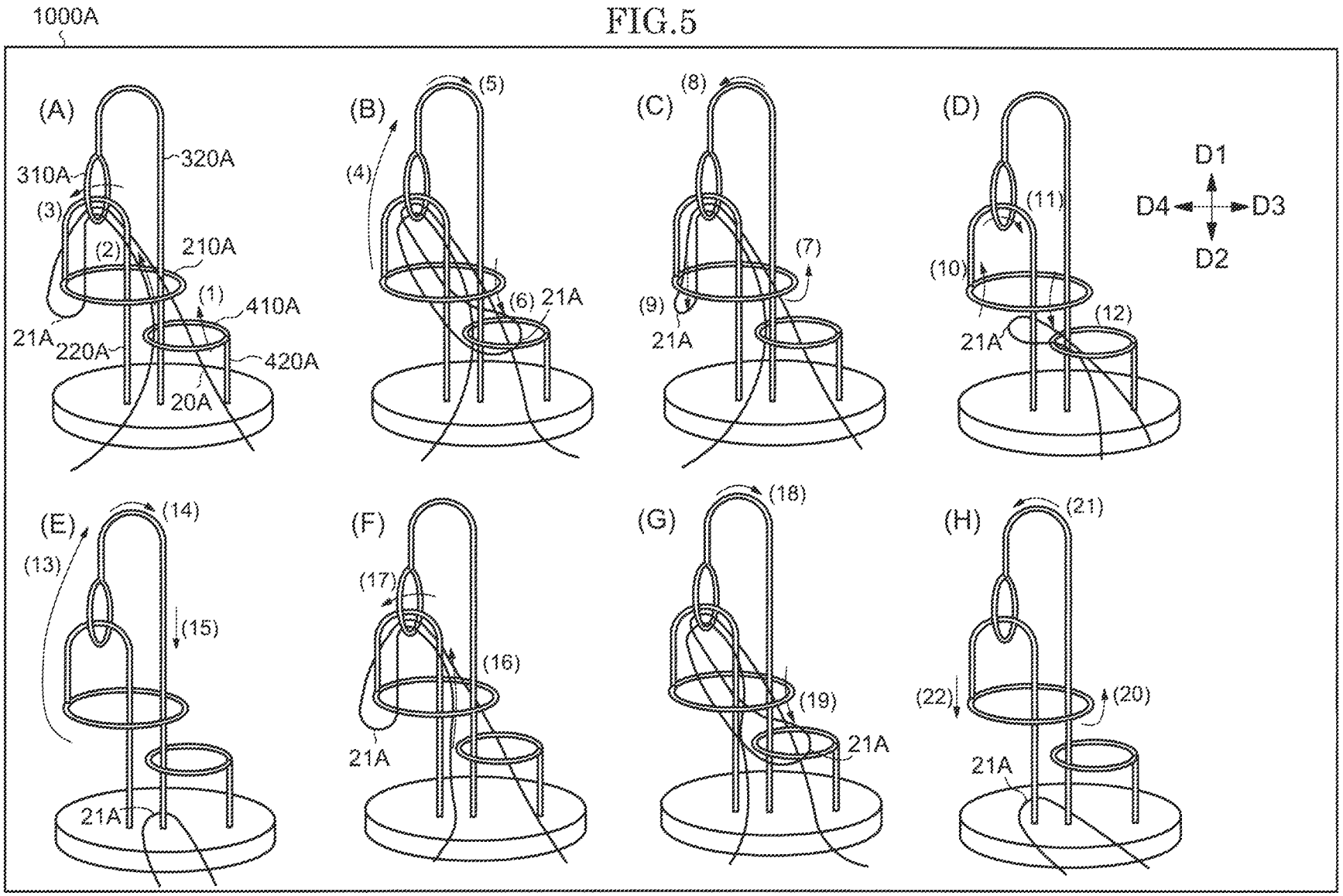
FIG. 5 is a diagram showing a method of solving a wisdom ring puzzle according to an embodiment of the present invention.

As shown in (B) of FIG. 5, the tip 21A of the lace 20A moves in the direction D4 with respect to the first ring unit 210A in the direction D1 along the first pole 220A and the second pole 320A (4), crosses over the uppermost portion of the second pole 320A in the direction D3 (5), moves in the direction D2 along the second pole 320A, and passes through the inner side of the first ring unit 210A in the direction D2 (6).

As shown in (C) of FIG. 5, the tip 21A of the lace 20A crosses over the outer side (direction D3 side) of the first ring unit 210A in the direction D1 (7), moves in the direction D1 along the second pole 320A, crosses over the uppermost portion of the second pole 320A in the direction D4 (8), moves in the direction D2 along the second pole 320A and the first pole 220A, and passes through the inner side of the first ring unit 210A in the direction D2 (9). That is, the lace 20A hangs on the inner side of the second ring unit 310A and hangs down in the direction D2. In this state, the lace 20A sandwiches only the first pole 220A.

As shown in (D) of FIG. 5, the tip 21A of the lace 20A passes through the inner side of the first ring unit 210A in the direction D1 (10), passes through the inner side of the second ring unit 310A in the direction D3 (11), and passes through the inner side of the first ring unit 210A in the direction D2 (12). As a result, the lace 20A is in a state of being entangled only with the first pole 220A and passing through the inner side of the third ring unit 410A.

As shown in (E) of FIG. 5, the tip 21A of the lace 20A crosses over the side of the direction D4 of the first ring unit 210A, moves in the direction D1 along the first pole 220A and the second pole 320A (13), crosses over the uppermost portion of the second pole 320A in the direction D3 (14), and moves in the direction D2 along the second pole 320A (15). As a result, the lace 20A is in a state of being entangled only with the second pole 320A. In this state, only the second pole 320A exists at the inner side of the lace 20A.

As shown in (F) of FIG. 5, the tip 21A of the lace 20A crosses over the outer side (direction D4 side) of the third ring unit 410A in the direction D1, passes through the inner side of the first ring unit 210A in the direction D1 (16), moves in the direction D1 along the first pole 220A, and passes through the inner side of the second ring unit 310A in the direction D4 (17). That is, the lace 20A hangs on the inner side of the second ring unit 310A and hangs down in the direction D2. In this state, the lace 20A in the vicinity of the tip 21A sandwiches the first pole 220A and is positioned at the outer side of the first ring unit 210A. A point that the lace 20A does not pass through the inner side of the third ring unit 410A (crosses over the outer side of the third ring unit 410A) and a point that the lace 20A sandwiches the first pole 220A are differences between the state shown in (A) of FIG. 5 and the state shown in (F) of FIG. 5.

As shown in (G) of FIG. 5, the tip 21A of the lace 20A crosses over the uppermost portion of the second pole 320A in the direction D3 (18), moves in the direction D2 along the second pole 320A, and passes through the inner side of the first ring unit 210A in the direction D2 (19).

As shown in (H) of FIG. 5, the tip 21A of the lace 20A crosses over the outer side (direction D3 side) of the first ring unit 210A in the direction D1 (20), moves in the direction D1 along the second pole 320A, crosses over the uppermost portion of the second pole 320A (21), moves in the direction D2 along the second pole 320A and the first pole 220A, and crosses over the outer side (direction D4 side) of the first ring unit 210A (22). In this state, the lace 20A is in a state of being entangled with the first pole 220A and the second pole 320A.

From this state, the tip 21A of the lace 20A moves in the reverse order of the above (20) to (22). That is, the tip 21A crosses over the outer side (direction D4 side) of the first ring unit 210A in the direction D1, moves in the direction D1 along the first pole 220A and the second pole 320A, crosses over the uppermost portion of the second pole 320A in the direction D3, moves in the direction D2 along the second pole 320A, and crosses over the outer side (direction D3 side) of the first ring unit 210A in the direction D2. As a result, the lace 20A is in a state of being entangled only with the third pole 420A (a state in which the puzzle is solved). In this state, only the third pole 420A exists at the inner side of the lace 20A.

2. Second Embodiment

Figure 6A:
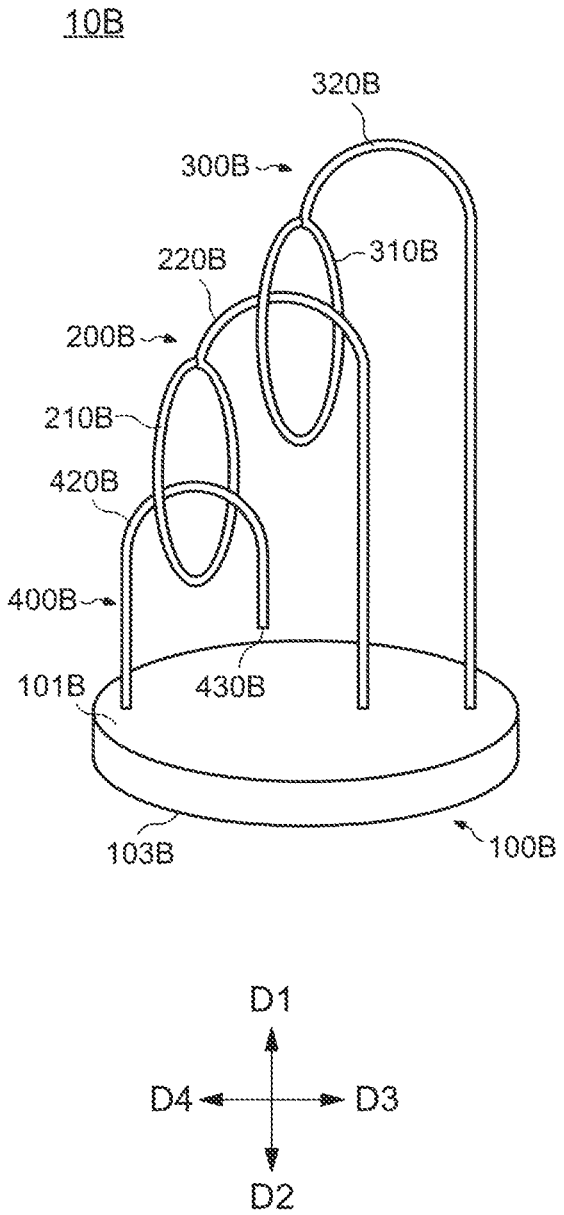
FIG. 6A is a diagram showing a structure of a wisdom ring puzzle according to an embodiment of the present invention.
Figure 6B:
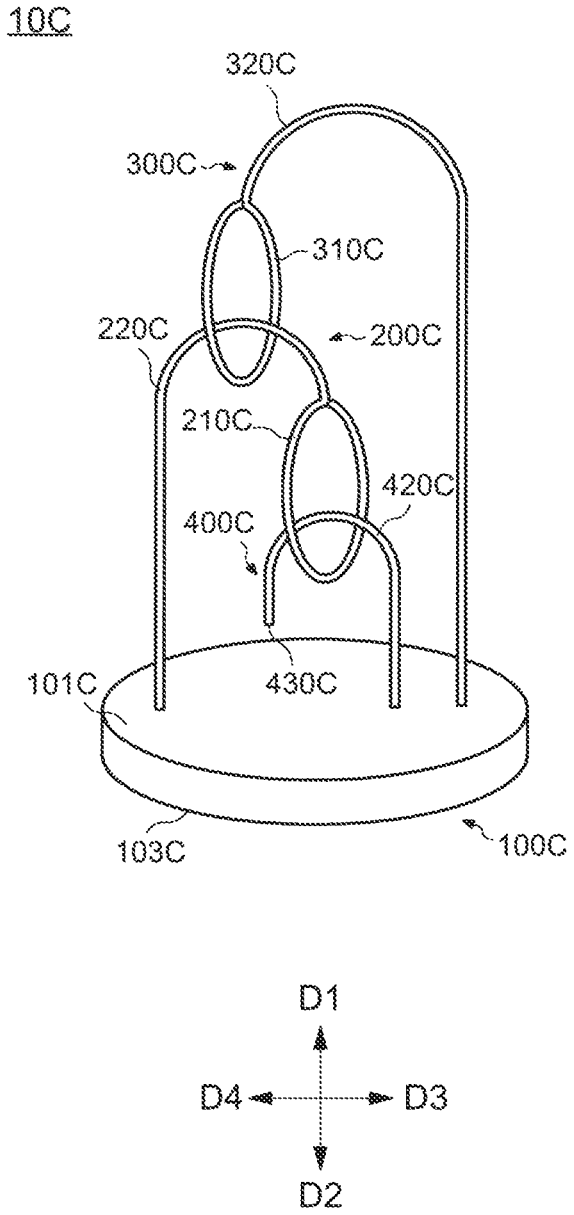
FIG. 6B is a diagram showing a structure of a wisdom ring puzzle according to an embodiment of the present invention.
Figure 7:
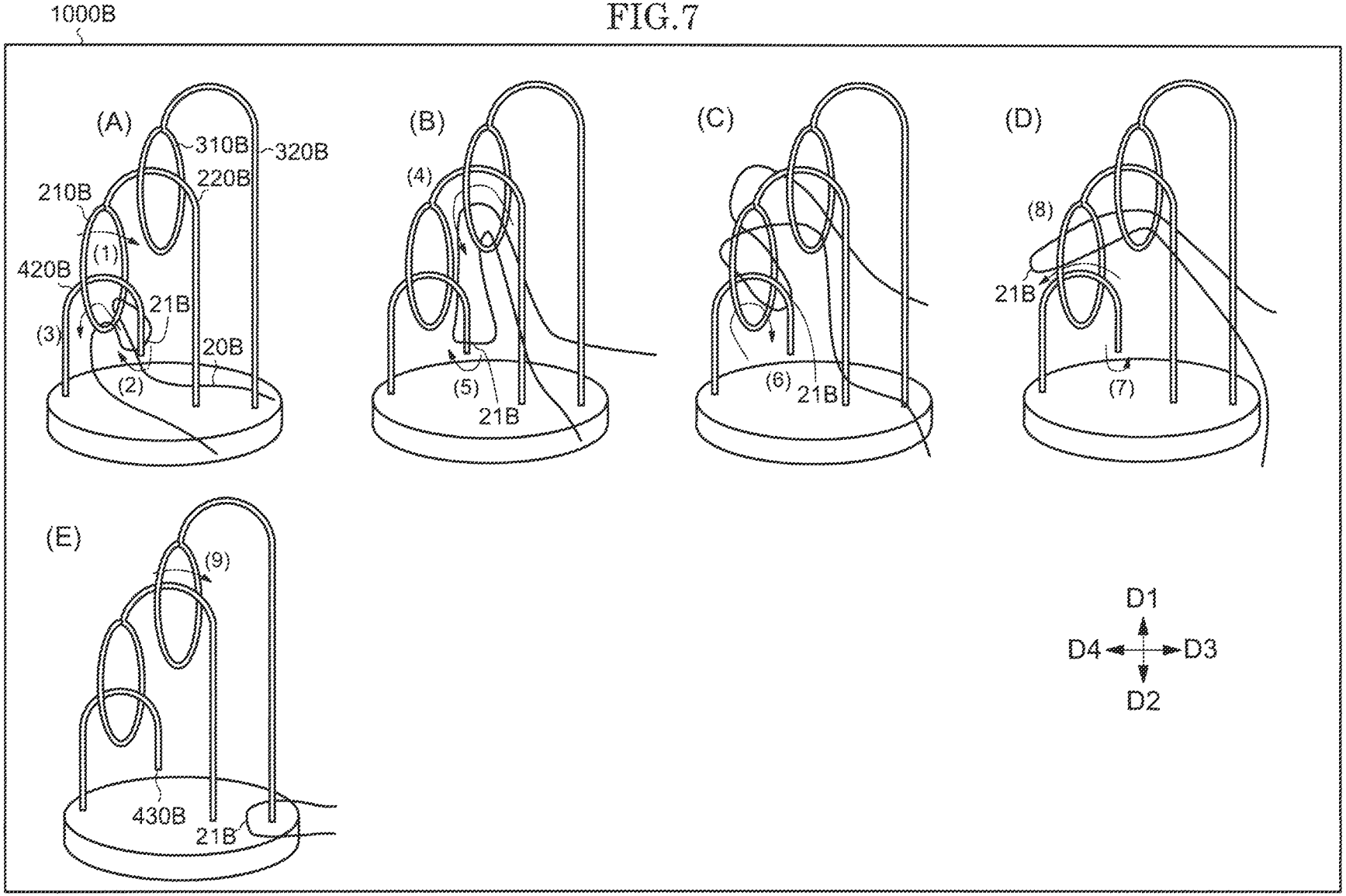
FIG. 7 is a diagram showing a method of solving a wisdom ring puzzle according to an embodiment of the present invention.
Figure 8:
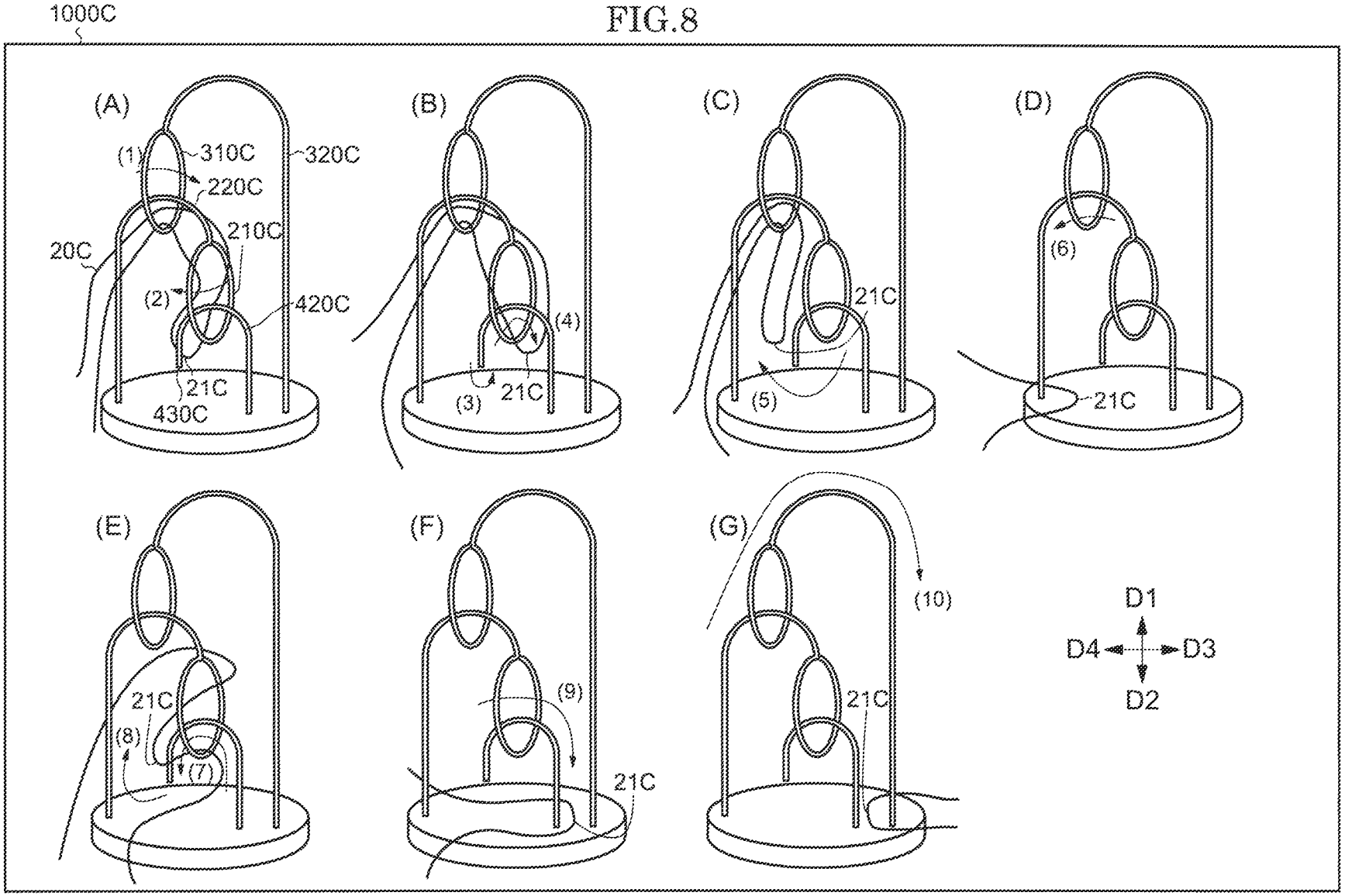
FIG. 8 is a diagram showing a method of solving a wisdom ring puzzle according to an embodiment of the present invention.

Wisdom ring puzzles 10B and 100 according to the second embodiment will be described with reference to FIG. 6A to FIG. 8. FIG. 6A and FIG. 6B are diagrams illustrating structures of wisdom ring puzzles according to embodiments of the present invention. FIG. 7 to FIG. 8 are diagrams showing a method of solving a wisdom ring puzzle according to an embodiment of the present invention. As in the first embodiment, the wisdom ring puzzles 10B and 100 are puzzles using laces 20B and 20C. The player enjoys the wisdom ring puzzles 20B and 20C by entangling the laces with the poles (for example, second poles 320B and 320C) arranged on the wisdom ring puzzles 10B and 100 or removing the laces from the poles. In the following description, description of the same configuration as that of the wisdom ring puzzle 10 of the first embodiment will be omitted. In the following description, in the case of describing the same configuration as the wisdom ring puzzle 10, the description may be omitted by adding the letters "B" or "C" after the symbols shown in FIG. 1A.

[2-1. Structure of Wisdom Ring Puzzle 10B]

As shown in FIG. 6A, the wisdom ring puzzle 10B includes a stage 100B, a first structure body 200B, a second structure body 300B, and a third structure body 400B.

The first structure body 200B includes a first ring unit 210B and a first pole 220B. The first ring unit 210B is arranged on a first virtual plane substantially orthogonal to an upper surface 101B. The first pole 220B is connected to the first ring unit 210B and has an upwardly convex U-shape. In other words, the first pole 220B is connected to the first ring unit 210B, extends in the direction D1 from a connection part with the first ring unit 210B, turns, extends in the direction D2, and reaches the stage 100B.

The second structure body 300B includes a second ring unit 310B and the second pole 320B. The second ring unit 310B is arranged on a second virtual plane substantially orthogonal to the upper surface 101B. The second pole 320B is connected to the second ring unit 310B and has an upwardly convex U-shape. In other words, the second pole 320B is connected to the second ring unit 310B, extends in the direction D1 from the connection part with the second ring unit 310B, turns, extends in the direction D2, and reaches the stage 100B.

The third structure body 400B includes a third pole 420B. The third pole 420B has an upwardly convex U-shaped shape. In other words, the third pole 420B is connected to the stage 100B, extends in the direction D1 from the stage 100B, turns and extends in the direction D2. A gap is arranged between a tip 430B of the third pole 420B extending in the direction D2 and the stage 100B.

The first ring unit 210B is positioned in the direction D1 with respect to the stage 100B. The second ring unit 310B is positioned in the direction D1 with respect to the first ring unit 210B. As described above, in the present embodiment, the first virtual plane on which the first ring unit 210B is arranged and the second virtual plane on which the second ring unit 310B is arranged are substantially orthogonal to the upper surface 101B. That is, the first virtual plane and the second virtual plane are parallel to each other. However, the relationship between the first and second virtual planes and the upper surface 101B is not limited to the above configuration.

The first ring unit 2108 is arranged in the direction D4 with respect to the first pole 220B. The second ring unit 310B is arranged in the direction D4 with respect to the second pole 320B. The tip 430B is arranged in the direction D3 with respect to a position where the third pole 420B is connected to the stage 1008. That is, although the first pole 220B and the second pole 320B are folded back in the same direction (direction D4), the third pole 420B turns in the direction (direction D3) opposite to the first pole 220B and the second pole 320B.

The above configuration will be described in detail. The first pole 220B extends in the direction D1 from the connection part with the first ring unit 210B and is connected to the stage 100B after passing through the inner side of the second ring unit 3108 in the direction D3. In a plan view, the first pole 220B extends in the direction D3 from the connection part with the first ring unit 210B and is connected to the stage 100B at a position between where the second pole 320B is connected to the stage 100B and the second ring unit 3108. The second pole 320B extends in the direction D1 from the second ring unit 310B and is connected to the stage 100B at a position opposite to the first ring unit 210B and the third pole 420B in a plan view. The third pole 420B extends in the direction D1 from the stage 100B and passes through the inner side of the first ring unit 210B in the direction D3. Therefore, in a plan view, the tip 430B is connected to the stage 220B at a position between where the first pole 220B is connected to the stage 100B and the first ring unit 210B.

In other words, in a plan view, the position where the first pole 220B is connected to the stage 100B is positioned between the position where the second pole 320B is connected to the stage 100B and the second ring unit 310B. The second ring unit 310B is positioned between a position where the first pole 220B is connected to the stage 100B and the first ring unit 210B.

[2-2. Structure of Wisdom Ring Puzzle 100]

As shown in FIG. 6B, the wisdom ring puzzle 100 includes a stage 100C, a first structure body 200C, a second structure body 300C, and a third structure body 400C. The wisdom ring puzzle 100 shown in FIG. 6B is similar to the wisdom ring puzzle 10B shown in FIG. 6A, but the directions of the first structure body 200C and the third structure body 400C are different from the first structure body 200B and the third structure body 400B of the wisdom ring puzzle 10B. In the following description, the difference between the wisdom ring puzzle 10B and the wisdom ring puzzle 100 will be mainly explained. In the following description, in the case of describing the same configuration as the wisdom ring puzzle 10B, the description may be omitted by adding the letter "C" instead of the letter "B" after the symbols shown in FIG. 6A.

As shown in FIG. 6B, in the wisdom ring puzzle 100, the directions of the first structure body 200C and the third structure body 400C are opposite to the directions of the first structure body 200B and the third structure body 400B in FIG. 6A. That is, a first ring unit 210C is arranged in the direction D3 with respect to a first pole 220C. A tip 430C is arranged in the direction D4 with respect to a position where a third pole 420C is connected to the stage 100C. That is, although the second pole 320C and the third pole 420C are folded back in the same direction (direction D4) after extending in the direction D1 from the stage 100C, the first pole 220C turns in the direction (direction D3) opposite to the second pole 320C and the third pole 420C.

The above configuration will be described in detail. In a plan view, the first pole 220C extends in the direction D4 from the connection part with the first ring unit 210C and is connected to the stage 100C at a position further in the direction D4 than the second ring unit 310C. In a plan view, the second pole 320C extends in the direction D3 from the connection part with the second ring unit 310C and is connected to the stage 100C at a position crossing over the first ring unit 210C and the third pole 420C (direction D3 side of the first ring unit 210C and the third pole 420C).

In other words, in a plan view, the first ring unit 210C is positioned between a position where the second pole 320C is connected to the stage 100C and the second ring unit 310C. The second ring unit 310C is positioned between a position where the first pole 220C is connected to the stage 100C and the first ring unit 210C.

In FIG. 6A and FIG. 6B, although a configuration in which the first poles 220B and 220C pass through the inner side of the second ring units 310B and 310C in the vicinity of the uppermost portion of the first poles 220B and 220C, it is not limited to this configuration. The first poles 220B and 220C may pass through the inner side of the second ring units 310B and 310C from the connection part between the first ring units 210B and 210C and the first poles 220B and 220C to the position where the first poles 100B and 100C connect to the first pole 220B. Therefore, for example, the second virtual plane on which the second ring units 310B and 310C are arranged may be parallel to the upper surface 101B of the stage 100B. Similarly, it is sufficient that the third poles 420B and 420C pass through the inner side of the first ring units 210B and 210C, and the first virtual plane arranged with the first ring units 210B and 210C may be parallel to the upper surface 101B.

[2-3. Method of Solving Wisdom Ring Puzzle 10B]

A method 1000B of solving the wisdom ring puzzle 10B shown in FIG. 6A will be described with reference to FIG. 7. The wisdom ring puzzle 10B is a puzzle targeting a state in which the lace 20B is entangled only with the second pole 320B (a state in which only the second pole 320B exists at the inner side of the lace 20B).

First, the lace 20B is arranged so that the first structure body 200B to the third structure body 400B are all positioned on the inner side of the lace 20B. That is, in a state where the lace 20B is placed on the stage 100B, the first pole 220B to the third pole 420B are sandwiched (surrounded) by the lace 20B. From that state, as shown in (A) of FIG. 7, a tip 21B of the lace 20B passes through the inner side of the first ring unit 210B in the direction D3 (1), crosses over the lower side of the tip 430B in the direction D4 (2), and passes through the inner side of the first ring unit 210B in the direction D4 (3). According to this operation, a state in which only the first pole 220B and the second pole 320B exist on the inner side of the lace 20B can be obtained.

As shown in (B) of FIG. 7, the tip 21B of the lace 20B moves upward along the first pole 220B, passes through the inner side of the second ring unit 310B in the direction D4 (4), and crosses over the lower side of the tip 430B in the direction D4 (5).

As shown in (C) of FIG. 7, the tip 21B of the lace 20B crosses over the lower side of the first ring unit 210B in the direction D4, turns and passes through the inner side of the first ring unit 210B in the direction D3 (6).

As shown in (D) of FIG. 7, the tip 21B of the lace 20B crosses over the lower side of the tip 430B in the direction D3 (7), moves upward along the third pole 420B, and passes through the inner side of the first ring unit 210B in the direction D4 (8). In this state, the lace 20B sandwiches the first ring unit 210B from the outer side of the first ring unit 210B.

As shown in (E) of FIG. 7, the tip 21B of the lace 20B moves in the direction D1 on the outer side (direction D4 side) of the first ring unit 210B, moves in the direction D1 along the first pole 220B, and passes through the inner side of the second ring unit 310B in the direction D3 (9). According to the operation (9) described above, the lace 20B is in a state of being entangled only with the second pole 320B (a state in which the puzzle is solved). In this state, only the second pole 320B exists at the inner side of the lace 20B.

[2-4. Method of Solving Wisdom Ring Puzzle 100]

A method 1000C of solving the wisdom ring puzzle 100 shown in FIG. 6B will be described with reference to FIG. 8. The wisdom ring puzzle 100 is a puzzle targeting a state in which a lace 20C is entangled only with the second pole 320C (a state in which only the second pole 320C exists at the inner side of the lace 20C) like the wisdom ring puzzle 10B.

As shown in (A) of FIG. 8, a tip 21C of the lace 20C passes through the inner side of the second ring unit 310C in the direction D3 (1), moves downward along the first pole 220C, and passes through the inner side of the first ring unit 210C in the direction D4 (2). In this state, the lace 20C sandwiches the first pole 220C.

As shown in (B) of FIG. 8, the tip 21C of the lace 20C crosses over the lower side of the tip 430C in the direction D3 (3) and passes through the inner side of the first ring unit 210C in the direction D3 (4). Although the state shown in (B) of FIG. 8 is similar to the state shown in (A) of FIG. 8, it is different in that the lace 20C is entangled with the third pole 420C.

As shown in (C) of FIG. 8, the tip 21C of the lace 20C crosses over the outer side (direction D2 side) of the first ring unit 210C in the direction D4 and crosses over the side of the direction D2 of the tip 430C in the direction D4 (5).

As shown in (D) of FIG. 8, the tip 21C of the lace 20C moves upward along the first pole 220C, passes through the inner side of the second ring unit 310C in the direction D4 (6), and moves downward along the first pole 220C. In this state, the lace 20C is in a state of being entangled only with the first pole 220C. That is, only the first pole 220C exists at the inner side of the lace 20C.

As shown in (E) of FIG. 8, the tip 21C of the lace 20C moves in the direction D1 along the third pole 420C, passes through the inner side of the first ring unit 210C in the direction D4, and crosses over the side of the direction D2 of the tip 430C in the direction D4 (7).

As shown in (F) of FIG. 8, the tip 21C of the lace 20C passes through the inner side of the first ring unit 210C in the direction D3 (9) and moves downward along the third pole 420C. In this state, the lace 20C is in a state of being entangled with the first pole 220C and the third pole 420C. That is, the first pole 220C and the third pole 420C exist on the inner side of the lace 20C.

As shown in (G) of FIG. 8, while the position of the tip 21C of the lace 20C is maintained between the second pole 320C and the third pole 420C, the other end (not shown) of the lace 20C moves in the direction D1 along the first pole 220C and the second pole 320C (10), crosses over the uppermost portion of the second pole 320C in the direction D3 (10), and moves in the direction D2 along the second pole 320C (10). According to this operation, the lace 20C is in a state of being entangled only with the second pole 320C (a state in which the puzzle is solved). In this state, only the second pole 320C exists at the inner side of the lace 20C.

3. Third Embodiment

Figure 9A:
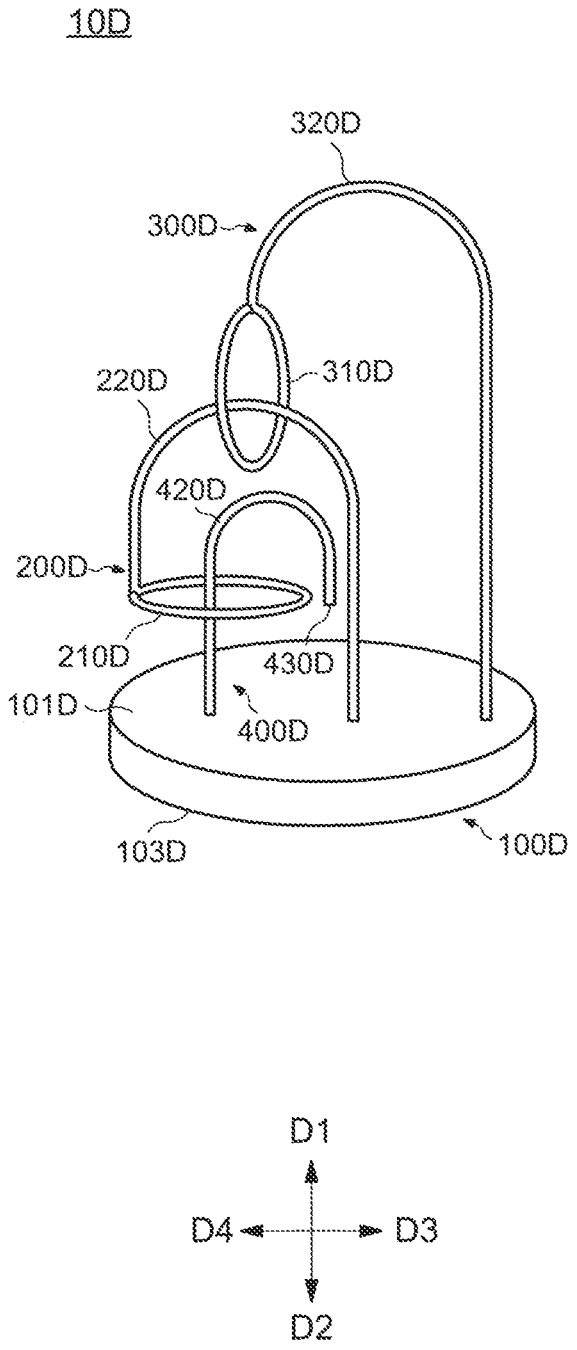
FIG. 9A is a diagram showing a structure of a wisdom ring puzzle according to an embodiment of the present invention.
Figure 9B:
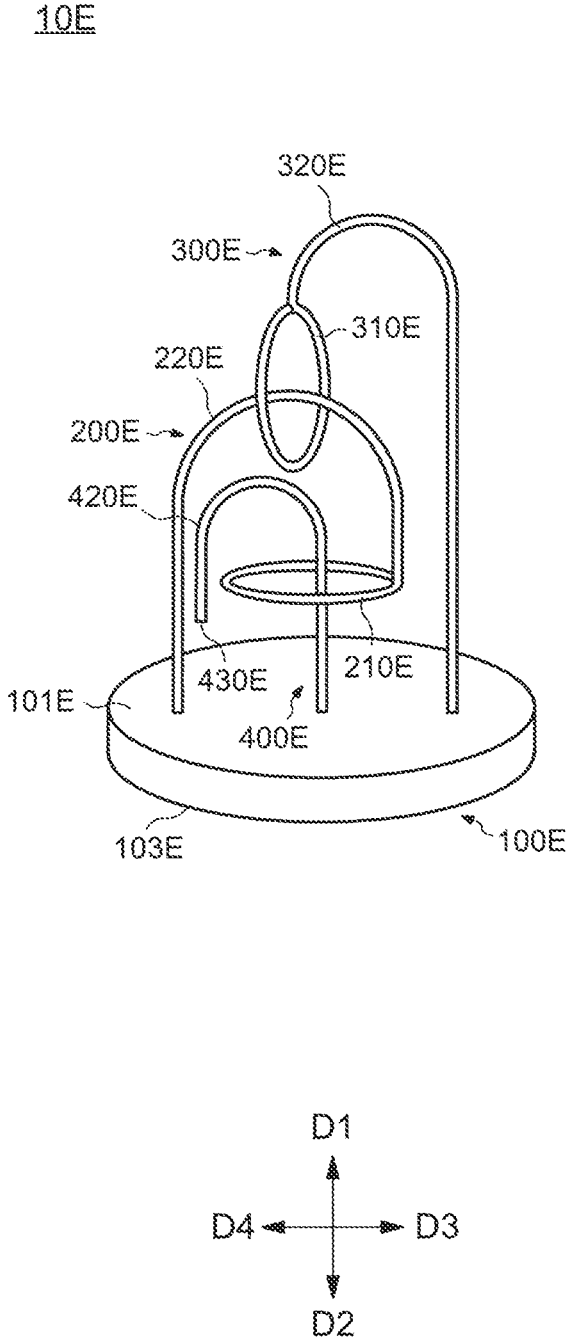
FIG. 9B is a diagram showing a structure of a wisdom ring puzzle according to an embodiment of the present invention.
Figure 10:
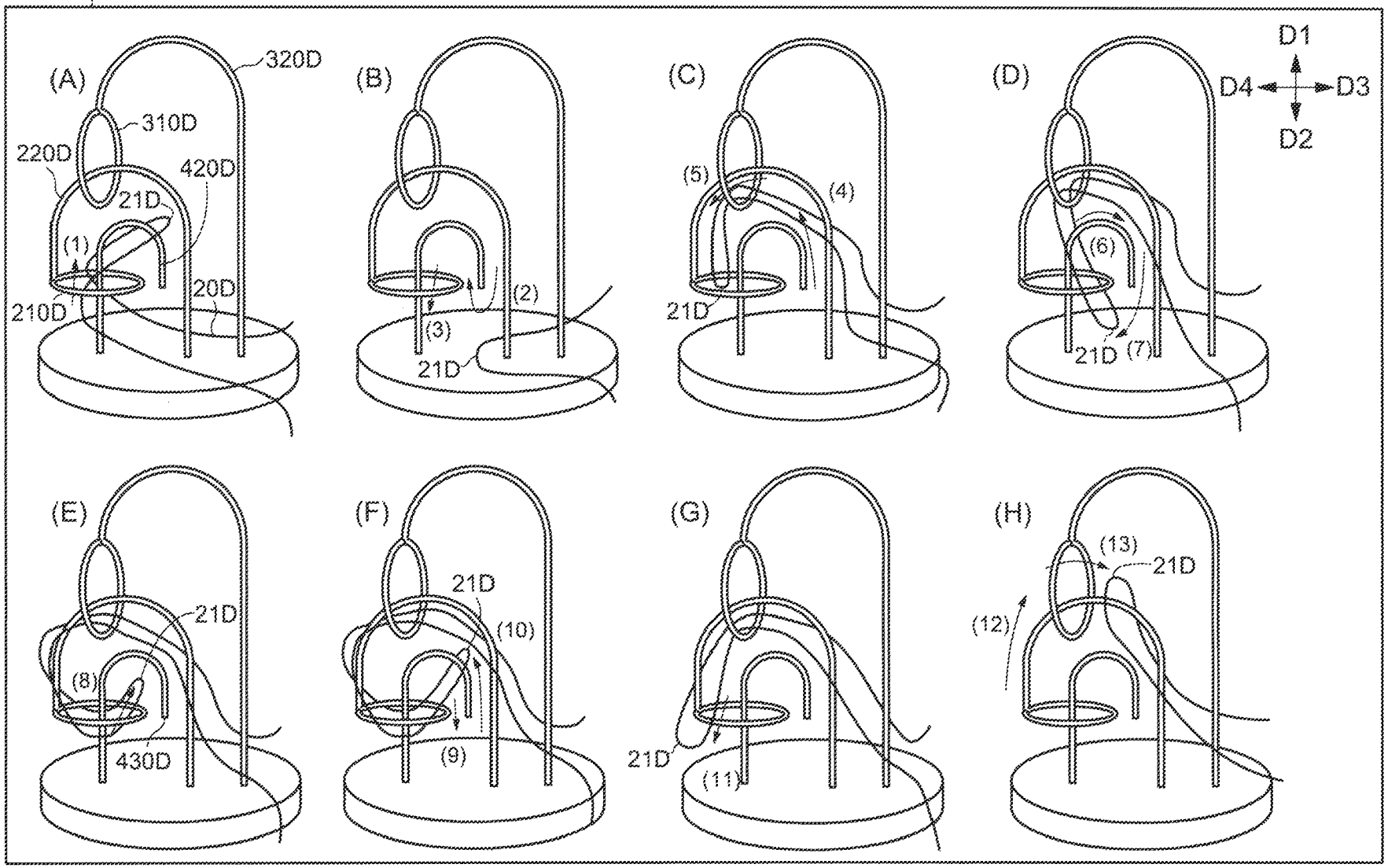
FIG. 10 is a diagram showing a method of solving a wisdom ring puzzle according to an embodiment of the present invention.
Figure 11:
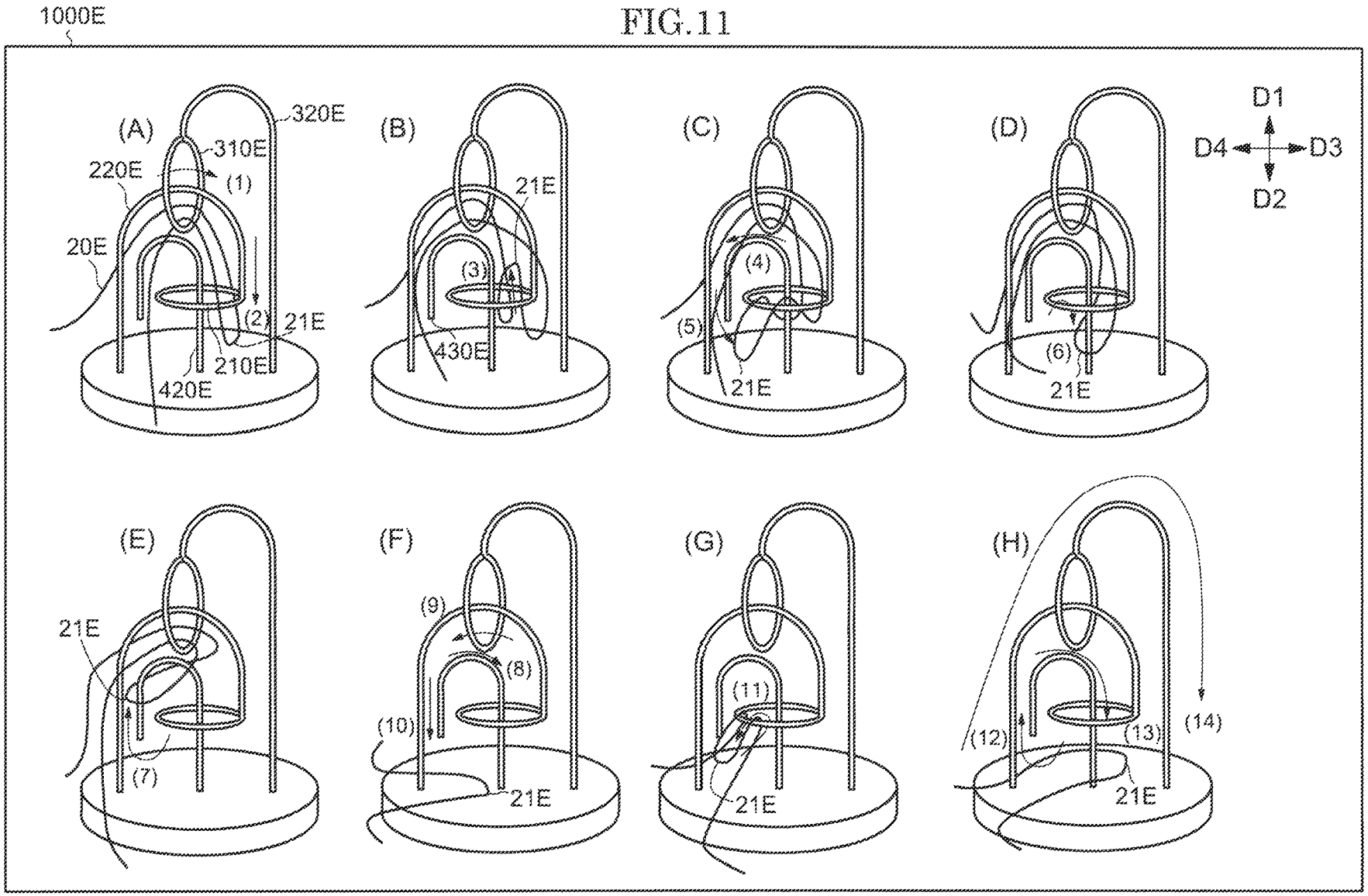
FIG. 11 is a diagram showing a method of solving a wisdom ring puzzle according to an embodiment of the present invention.

The wisdom ring puzzles 10D and 10E according to the third embodiment will be described with reference to FIG. 9A to FIG. 11. FIG. 9A and FIG. 9B are diagrams illustrating structures of wisdom ring puzzles according to embodiments of the present invention. FIG. 10 to FIG. 11 are diagrams showing a method of solving a wisdom ring puzzle according to an embodiment of the present invention. As in the first and second embodiments, the wisdom ring puzzles 10D and 10E are puzzles using laces 20D, and 20E. The player enjoys the wisdom ring puzzles 20D and 20E by entangling the laces with the poles (for example, second poles 320D and 320E) arranged on the wisdom ring puzzles 10D and 10E or removing the laces from the poles. In the following description, description of the same configuration as that of the wisdom ring puzzle 10 of the first embodiment will be omitted. In the following description, in the case of describing the same configuration as the wisdom ring puzzle 10, the description may be omitted by adding the letters "D" or "E" after the symbols shown in FIG. 1A.

[3-1. Structure of Wisdom Ring Puzzle 10D]

As shown in FIG. 9A, the wisdom ring puzzle 10D includes a stage 100D, a first structure body 200D, a second structure body 300D, and a third structure body 400D.

The first structure body 200D includes a first ring unit 210D and a first pole 220D. The first ring unit 210D is arranged on the first virtual plane substantially parallel to an upper surface 101D. The first pole 220D is connected to the first ring unit 210D and has an upwardly convex U-shape. In other words, the first pole 220D is connected to the first ring unit 210D, extends in the direction D1 from the connection part with the first ring unit 210D, turns and extends in the direction D2. The first pole 220D extending in the direction D2 reaches the stage 100D crossing over the outer side (direction D3 side) of the first ring unit 210D. In a plan view, the first pole 220D is connected to the first ring unit 210D at an end portion of the first ring unit 210D in the direction D4. The first pole 220D extends in the direction D3 from the connection part with the first ring unit 210D, crosses the first ring unit 210D, and reaches the stage 100D.

The second structure body 300D includes a second ring unit 310D and the second pole 320D. The second ring unit 310D is arranged on a second virtual plane substantially orthogonal to the upper surface 101D. The second pole 320D is connected to the second ring unit 310D and has an upwardly convex U-shape. In other words, the second pole 320D is connected to the second ring unit 310D, extends in the direction D1 from the connection part with the second ring unit 310D, turns and extends in the direction D2, and reaches the stage 100D.

The third structure body 400D includes a third pole 420D. The third pole 420D has an upwardly convex U-shaped shape. In other words, the third pole 420D is connected to the stage 100D, extends in the direction D1 from the stage 100D, turns and extends in the direction D2. A gap is arranged between a tip 430D of the third pole 420D extending in the direction D2 and the stage 100D.

The first ring unit 210D is positioned in the direction D1 with respect to the stage 100D. The second ring unit 310D is positioned in the direction D1 with respect to the first ring unit 210D. As described above, in the present embodiment, the first virtual plane on which the first ring unit 210D is arranged is substantially parallel to the upper surface 101D, and the second virtual plane on which the second ring unit 310D is arranged is substantially orthogonal to the upper surface 101D. However, the present invention is not limited to the above configuration. For example, the angle formed by the upper surface 101D and the first virtual plane may be smaller than the angle formed by the upper surface 101D and the second virtual plane.

The first pole 220D extends in the direction D1 from the connection part with the first ring unit 210D and crosses over the outer side (direction D3 side) of the first ring unit 210D in the direction D2 after passing through the inner side of the second ring unit 310D. Since the second ring unit 310D is positioned in the direction D1 with respect to the first ring unit 210D, the first pole 220D passes through the inner side of the second ring unit 310D at the side of the direction D1 of the first ring unit 210D. In a plan view, the first pole 220D extends from the connection part with the first ring unit 210D toward (direction D3) the position where the second pole 320D is connected to the stage 100D, passes through the inner side of the second ring unit 310D, and is connected to the stage 100D at a position crossing over the tip 430D. In a plan view, the second pole 320D extends in the direction D3 from the second ring unit 310D and is connected to the stage 100D at a position crossing over the position where the first pole 220D is connected to the stage 100D.

The first ring unit 210D is connected to the first pole 220D at the side of the direction D4 of the first pole 220D. The second ring unit 310D is arranged in the direction D4 with respect to the second pole 320D. The tip 430D is arranged in the direction D3 with respect to a position where the third pole 420D is connected to the stage 100D. That is, although the first pole 220D and the second pole 320D are folded back in the same direction (direction D4), the third pole 420D turns in the direction opposite to the first pole 220D and the second pole 320D (direction D3). The third pole 420D extends in the direction D1 from the stage 100D and passes through the inner side of the first ring unit 210D in the direction D1.

In other words, in a plan view, the position where the first pole 220D is connected to the stage 100D is positioned between the position where the second pole 320D is connected to the stage 100D and the second ring unit 310D. The second ring unit 310D is positioned between the position where the first ring unit 210D is connected to the first pole 220D and the position where the first pole 220D is connected to the stage 100D.

[3-2. Structure of Wisdom Ring Puzzle 10E]

As shown in FIG. 9B, a wisdom ring puzzle 10E includes a stage 100E, a first structure body 200E, a second structure body 300E, and a third structure body 400E. The wisdom ring puzzle 10E shown in FIG. 9B is similar to the wisdom ring puzzle 10D shown in FIG. 9A, but the directions of the first structure body 200E and the third structure body 400E are different from the first structure body 200D and the third structure body 400D of the wisdom ring puzzle 10D. In the following description, the difference between the wisdom ring puzzle 10D and the wisdom ring puzzle 10E will be mainly explained. In the following description, in the case of describing the same configuration as the wisdom ring puzzle 10D, the description may be omitted by adding the letter "E" instead of the letter "D" after the symbols shown in FIG. 9A.

As shown in FIG. 9B, in the wisdom ring puzzle 10E, the directions of the first structure body 200E and the third structure body 400E are opposite to the directions of the first structure body 200D and the third structure body 400D in FIG. 9A. That is, the first ring unit 210E is arranged in the direction D3 with respect to a position where the first pole 220E is connected to the stage 100E. A tip 430E is arranged in the direction D4 with respect to a position where a third pole 420E is connected to the stage 100E. That is, the second pole 320E and the third pole 420E are folded back toward the same direction (direction D3) after extending in the direction D1 from the stage 100E, but the first pole 220E turns toward the opposite direction (direction D4) from the second pole 320E and the third pole 420E after extending in the direction D1 from the stage 100E.

The above configuration will be described in detail. In a plan view, the first pole 220E extends in the direction D4 from a connection part with the first ring unit 210E, passes through the inner side of a second ring unit 310E, and is connected to the stage 100E at a position crossing over the tip 430E. In a plan view, the second pole 320E extends in the direction D3 from the second ring unit 310E and is connected to the stage 100E at a position crossing over the first ring unit 210E.

In other words, in a plan view, the position where the first ring unit 210E is connected to the first pole 220E is positioned between the position where the second pole 320E is connected to the stage 100E and the second ring unit 310E. The second ring unit 310E is positioned between a position where the first ring unit 210E is connected to the first pole 220E and a position where the first pole 220E is connected to the stage 100E.

In FIG. 9A and FIG. 9B, although a configuration in which the first poles 220D and 220E pass through the inner side of the second ring units 310D and 310E in the vicinity of the uppermost portion of the first poles 220D and 220E is shown, it is not limited to this configuration. It is sufficient that the first poles 220D and 220E pass through the inner side of the second ring units 310D and 310E between the connection part between the first ring units 210D and 210E and the position where the first poles 100D and 100E connect to the first pole 220D. Therefore, for example, the second virtual plane on which the second ring units 310D and 310E are arranged may be parallel to the upper surface 101D of the stage 100D. Similarly, it is sufficient that the third poles 420D and 420E pass through the inner side of the first ring units 210D and 210E, and the first virtual plane arranged with the first ring units 210D and 210E may not be parallel to the upper surface 101D.

[3-3. Method of Solving Wisdom Ring Puzzle 10D]

A method 1000D of solving the wisdom ring puzzle 10D shown in FIG. 9A will be described with reference to FIG. 10. The wisdom ring puzzle 10D is a puzzle targeting a state in which the lace 20D is entangled only with the second pole 320D (a state in which only the second pole 320D exists at the inner side of the lace 20D).

First, the lace 20D is arranged so that the first structure body 200D to the third structure body 400D are all positioned on the inner side of the lace 20D. That is, in a state where the lace 20D is placed on the stage 100D, the first pole 220D to the third pole 420D are sandwiched (surrounded) by the lace 20D. From that state, as shown in (A) of FIG. 10, the tip 21D of the lace 20D passes through the inner side of the first ring unit 210D in the direction D1 (1).

As shown in (B) of FIG. 10, the tip 21D of the lace 20D moves in the direction D2 toward the tip 430D between the third pole 420D and the first pole 220D, crosses over the tip 430D in the direction D4 (2), and moves in the direction D4 with respect to the third pole 420D in the direction D1 (2). Thereafter, the tip 21D passes through the inner side of the first ring unit 210D in the direction D2 (3). According to this operation, a state in which only the first pole 220D and the second pole 320D exist on the inner side of the lace 20D can be obtained.

As shown in (C) of FIG. 10, the tip 21D of the lace 20D moves between the third pole 420D and the first pole 220D in the direction D1 (4) and passes through the inner side of the second ring unit 310D in the direction D4 (5). That is, the lace 20D hangs on the inner side of the second ring unit 310D and hangs down in the direction D2.

As shown in (D) of FIG. 10, the tip 21D of the lace 20D crosses over the uppermost portion of the third pole 420D in the direction D3 (6), moves in the direction D2 toward the tip 430D between the third pole 420D and the first pole 220D (7), and crosses over the tip 430D in the direction D4. In this state, the lace 20D sandwiches the first ring unit 210D from the outer side of the first ring unit 210D.

As shown in (E) of FIG. 10, the tip 21D of the lace 20D passes through the inner side of the first ring unit 210D in the direction D1 (8). That is, the lace 20D enters the inner side of the first ring unit 210D from the outer side of the first ring unit 210D.

As shown in (F) of FIG. 10, the tip 21D of the lace 20D crosses over the outer side (direction D3 side) of the first ring unit 210D in the direction D2 (9), moves in the direction D2 along the third pole 420D, crosses over the tip 430D in the direction D3, moves in the direction D1 between the third pole 420D and the first pole 220D (10), and moves in the direction D1 along the third pole 21D.

As shown in (G) of FIG. 10, the tip 21D of the lace 20D crosses over the uppermost portion of the third pole 420D in the direction D4 and passes through the inner side of the first ring unit 210D in the direction D2 (11). In this state, the lace 20D in the vicinity of the tip 21D is positioned at the outer side of the first ring unit 210D. This is the difference between the state shown in (C) of FIG. 10 and the state shown in (G) of FIG. 10.

As shown in (H) of FIG. 10, the tip 21D of the lace 20D crosses over the outer side (direction D4 side) of the first ring unit 210D in the direction D1 (12), moves in the direction D1 along the first pole 220D (12), and passes through the inner side of the second ring unit 310D in the direction D3 (13). Thereafter, as the tip 21D moves along the first pole 220D in the direction D2, the lace 20D is in a state of being entangled only with the second pole 320D (a state in which the puzzle is solved). In this state, only the second pole 320D exists at the inner side of the lace 20D.

[3-4. Method of Solving Wisdom Ring Puzzle 10E]

A method 1000E of solving the wisdom ring puzzle 10E shown in FIG. 9B will be described with reference to FIG. 11. The wisdom ring puzzle 10E is a puzzle targeting a state in which a lace 20E is entangled only with the second pole 320E (a state in which only the second pole 320E exists at the inner side of the lace 20E).

As shown in (A) of FIG. 11, a tip 21E of the lace 20E passes through the inner side of the second ring unit 310E in the direction D3 (1) and moves in the direction D2 along the first pole 220E (2). In this state, the lace 20E in the vicinity of the tip 21E is positioned at the outer side of the first ring unit 210E.

As shown in (B) of FIG. 11, the tip 21E of the lace 20E passes through the inner side of the first ring unit 210E in the direction D1 (3). That is, the lace 20E enters the inner side of the first ring unit 210E from the outer side of the first ring unit 210E.

As shown in (C) of FIG. 11, the tip 21E of the lace 20E crosses over the uppermost portion of the third pole 420E in an area in the direction D2 with respect to the second ring unit 310E (4), moves in the direction D2 between the third pole 420E and the first pole 220E, and crosses over the tip 430E in the direction D2.

As shown in (D) of FIG. 11, the tip 21E of the lace 20E crosses over the side of the direction D1 of the first ring unit 210E from the outer side of the first ring unit 210E and passes through the inner side of the first ring unit 210E in the direction D2 (6).

As shown in (E) of FIG. 11, the tip 21E of the lace 20E crosses over the tip 430E in the direction D4 and moves in the direction D1 between the third pole 420E and the first pole 220E (7).

As shown in (F) of FIG. 11, the tip 21E of the lace 20E crosses over the uppermost portion of the third pole 420E in the direction D3 in an area in the direction D2 with respect to the second ring unit 310E (8), passes through the inner side of the second ring unit 310E in the direction D4 (9), moves between the third pole 420E and the first pole 220E in the direction D2 (10), and crosses over the tip 430E in the direction D2. In this state, the lace 20E is in a state of being entangled only with the first pole 220E. In this state, only the first pole 220E exists at the inner side of the lace 20E.

As shown in (G) of FIG. 11, the tip 21E of the lace 20E passes through the inner side of the first ring unit 210E in the direction D1, crosses over the side of the direction D1 of the first ring unit 210E in the direction D4, and moves in the direction D4 with respect to the first ring unit 210E in the direction D2 (11). That is, the lace 20E is hung on the first ring unit 210E such that the tip 21E is directed from the inner side to the outer side of the first ring unit 210E.

As shown in (H) of FIG. 11, the tip 21E of the lace 20E crosses over the tip 430E in the direction D4, moves in the direction D1 between the third pole 420E and the first pole 220E (12), crosses over the uppermost portion of the third pole 420E in the direction D3 in an area in the direction D2 with respect to the second ring unit 310E, and passes through the inner side of the first ring unit 210E in the direction D2 (13). In this state, the lace 20E is entangled with the first pole 220E and the third pole 420E. In this state, only the first pole 220E and the third pole 420E exist on the inner side of the lace 20E.

From the state shown in (H) of FIG. 11, while the position of the tip 21E of the lace 20E is maintained between the second pole 320E and the third pole 420E, the other end (not shown) of the lace 20E moves in the direction D1 along the first pole 220E and the second pole 320E, crosses over the uppermost portion of the second pole 320E in the direction D3, and moves in the direction D2 along the second pole 320E (14). According to this operation, the lace 20E is in a state of being entangled only with the second pole 320E (a state in which the puzzle is solved). In this state, only the second pole 320E exists at the inner side of the lace 20E.

4. Fourth Embodiment

Figure 12:
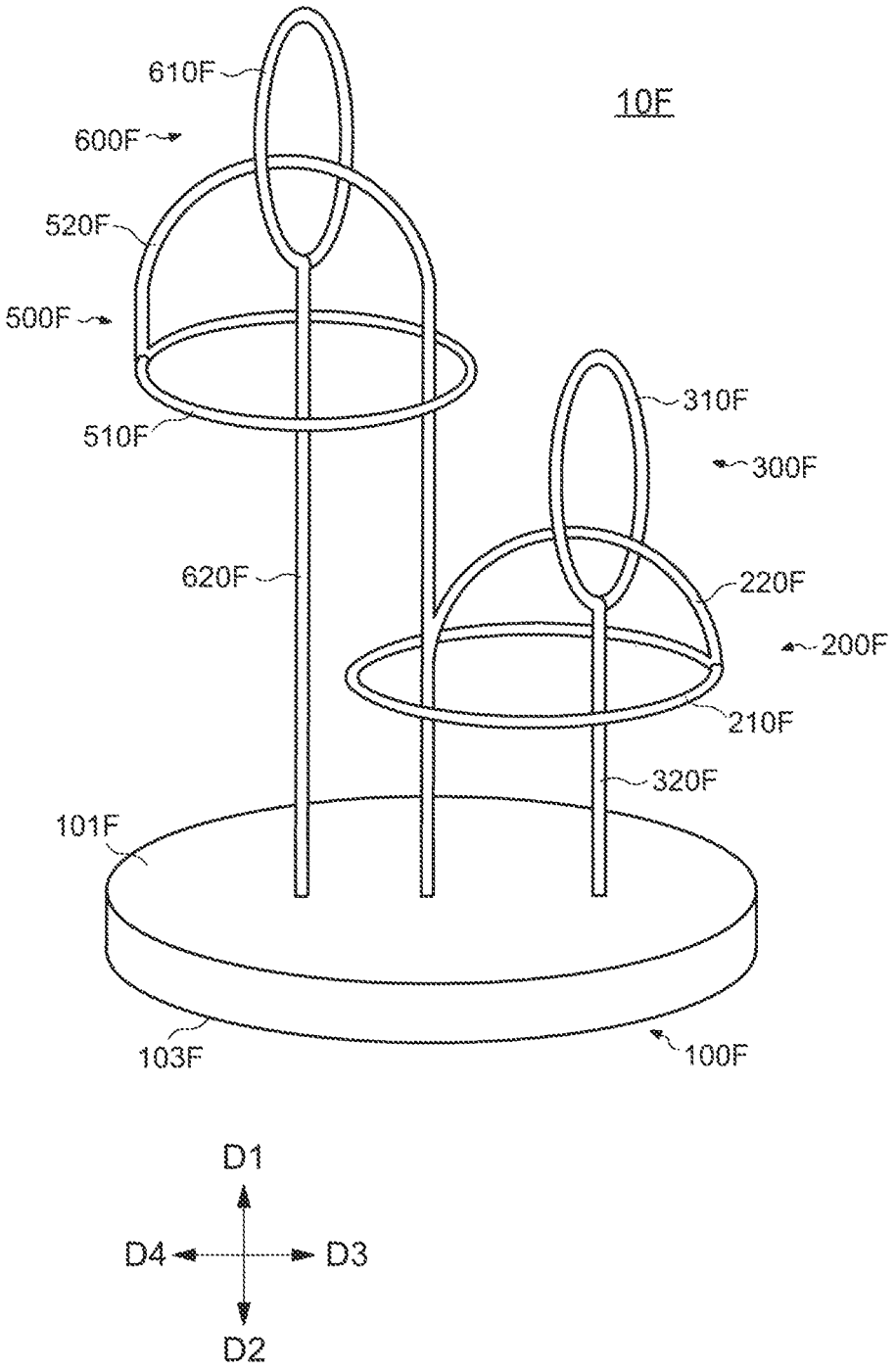
FIG. 12 is a diagram showing a structure of a wisdom ring puzzle according to an embodiment of the present invention.

A wisdom ring puzzle 10F according to the fourth embodiment will be described with reference to FIG. 12 to FIG. 16. FIG. 12 is a diagram illustrating a structure of a wisdom ring puzzle according to an embodiment of the present invention. FIG. 13 to FIG. 16 are diagrams showing a method of solving a wisdom ring puzzle according to an embodiment of the present invention. As in the first to third embodiments, the wisdom ring puzzle 10F is a puzzle using a lace 20F. The player enjoys the wisdom ring puzzle 10F by entangling the lace 20F with a pole (for example, a second pole 320F) arranged on the wisdom ring puzzle 10F or removing the lace 20F from the pole. In the following description, description of the same configuration as that of the wisdom ring puzzle 10 of the first embodiment will be omitted. In the following description, in the case of describing the same configuration as the wisdom ring puzzle 10, the description may be omitted by adding the letter "F" after the symbols shown in FIG. 1A.

[4-1. Structure Wisdom Ring Puzzle 10F]

As shown in FIG. 12, the wisdom ring puzzle 10F includes a stage 100F, a first structure body 200F, a second structure body 300F, a third structure body 500F, and a fourth structure body 600F.

The first structure body 200F includes a first ring unit 210F and a first pole 220F. The first ring unit 210F is arranged on a first virtual plane substantially parallel to an upper surface 101F. The first pole 220F is connected to the first ring unit 210F and has an upwardly convex U-shaped shape. In other words, the first pole 220F is connected to the first ring unit 210F, extends in the direction D1 from a connection part with the first ring unit 210F, turns and extends in the direction D2. The first pole 220F extending in the direction D2 passes through the inner side of the first ring unit 210F and reaches the stage 100F. In a plan view, the first pole 220F is connected to the first ring unit 210F at an end portion of the first ring unit 210F in the direction D3. In a plan view, the first pole 220F extends in the direction D4 from the connection part with the first ring unit 210F and reaches the stage 100F at the inner side of the first ring unit 210F.

The second structure body 300F includes a second ring unit 310F and a second pole 320F. The second ring unit 310F is arranged on a second virtual plane substantially orthogonal to the upper surface 101F. The second pole 320F extends from an end portion of the second ring unit 310F in the direction D2 toward the stage 100F and is connected to the stage 100F. However, a position where the second pole 320F is connected to the second ring unit 310F is not limited to the above-described configuration.

The third structure body 500F includes a third ring unit 510F and a third pole 520F. The third ring unit 510F is arranged on a third virtual plane substantially parallel to the upper surface 101F. The third pole 520F is connected to the third ring unit 510F and has an upwardly convex U-shaped shape. In other words, the third pole 520F is connected to the third ring unit 510F, extends in the direction D1 from a connection part with the third ring unit 510F, turns and extends in the direction D2. The third pole 520F extending in the direction D2 passes through the inner side of the third ring unit 510F and reaches the stage 100F. In a plan view, the third pole 520F is connected to the third ring unit 510F at an end portion of the third ring unit 510F in the direction D4. In a plan view, the third pole 520F extends in the direction D3 from a connection part with the third ring unit 510F and reaches the stage 100F at the inner side of the third ring unit 510F. Although details will be described later, in the present embodiment, the first pole 220F and the third pole 520F are partially common. Therefore, in the following description, a part of the third pole 520F that is in common with the first pole 220F may be referred to as the first pole 220F. However, the first pole 220F and the third pole 520F may be independent. Further, a position where the third pole 520F is connected to the third ring unit 510F is not limited to the above-described configuration.

The fourth structure body 600F includes a fourth ring unit 610F and a fourth pole 620F. The fourth ring unit 610F is arranged on a fourth virtual plane substantially orthogonal to the upper surface 101F. The fourth pole 620F extends from an end portion of the fourth ring unit 610F in the direction D2 toward the stage 100F and is connected to the stage 100F. However, a position where the fourth pole 620F is connected to the fourth ring unit 610F is not limited to the above-described configuration.

The first ring unit 210F is positioned in the direction D1 with respect to the stage 100F. The second ring unit 310F is positioned in the direction D1 with respect to the first ring unit 210F. The third ring unit 510F is positioned in the direction D1 with respect to the first ring unit 210F. The fourth ring unit 610F is positioned in the direction D1 with respect to the third ring unit 510F. As described above, in the present embodiment, the first virtual plane on which the first ring unit 210F is arranged and the third virtual plane on which the third ring unit 510F is arranged are substantially parallel to the upper surface 101F. The second virtual plane on which the second ring unit 310F is arranged and the fourth virtual plane on which the fourth ring unit 610F is arranged are substantially orthogonal to the upper surface 101F. However, the present invention is not limited to the above configuration. For example, the angle formed by the upper surface 101F and the first virtual plane and the angle formed by the upper surface 101F and the third virtual plane may be smaller than the angle formed by the upper surface 101F and the second virtual plane and the angle formed by the upper surface 101F and the fourth virtual plane.

In the present embodiment, although the configuration in which all of the fourth ring units 610F are positioned in the direction D1 with respect to the third ring unit 510F is exemplified, the configuration is not limited to this configuration. For example, a part of the fourth ring unit 610F may be positioned in the direction D1 with respect to the third ring unit 510F. That is, when viewed from the side, the third ring unit 510F and the fourth ring unit 610F may intersect.

The first pole 220F extends in the direction D1 from the connection part with the first ring unit 210F, passes through the inner side of the second ring unit 310F, and then passes through the inner side of the first ring unit 210F in the direction D2. In the present embodiment, although the first pole 220F passes through the inner side of the second ring unit 310F in the vicinity of the uppermost portion of the first pole 220F, it is not limited to this configuration. For example, it is sufficient that the first pole 220F passes through the inner side of the second ring unit 310F between the connection part with the first ring unit 210F and the position passing through the inner side of the first ring unit 210F in the direction D2. In a plan view, the first pole 220F extends from the connection part with the first ring unit 210F toward the fourth pole 620F (direction D4), passes through the inner side of the second ring unit 310F, and is connected to the stage 100F in an area where the first ring unit 210F and the third ring unit 510F overlap.

The second pole 320F extends in the direction D2 from the end portion of the second ring unit 310F in the direction D2. The second pole 320F passes through the inner side of the first ring unit 210F in the direction D2 and is connected to the stage 100F.

The third pole 520F extends in the direction D1 from the connection part with the third ring unit 510F, passes through the inner side of the fourth ring unit 610F, and then passes through the inner side of the third ring unit 510F in the direction D2. In the present embodiment, although the third pole 520F passes through the inner side of the fourth ring unit 610F in the vicinity of the uppermost portion of the third pole 520F, it is not limited to this configuration. For example, it is sufficient that the third pole 520F passes through the inner side of the fourth ring unit 610F between the connection part with the third ring unit 510F and the position passing through the inner side of the third ring unit 510F in the direction D2. In a plan view, the third pole 520F extends from the connection part with the third ring unit 510F toward the second pole 320F (direction D3), passes through the inner side of the fourth ring unit 610F, and is connected to the stage 100F in an area where the first ring unit 210F and the third ring unit 510F overlap.

The fourth pole 620F extends in the direction D2 from the end portion of the fourth ring unit 610F in the direction D2. The fourth pole 620F passes through the inner side of the third ring unit 510F in the direction D2 and is connected to the stage 100F.

[4-2. Method of Solving Wisdom Ring Puzzle 10F (Part 1)]

A method 1000F of solving the wisdom ring puzzle 10F shown in FIG. 12 will be described with reference to FIG. 13 and FIG. 14. The wisdom ring puzzle 10F is a puzzle targeting a state in which the lace 20F is entangled only with the second pole 320F (a state in which only the second pole 320F exists at the inner side of the lace 20F).

Figure 13:
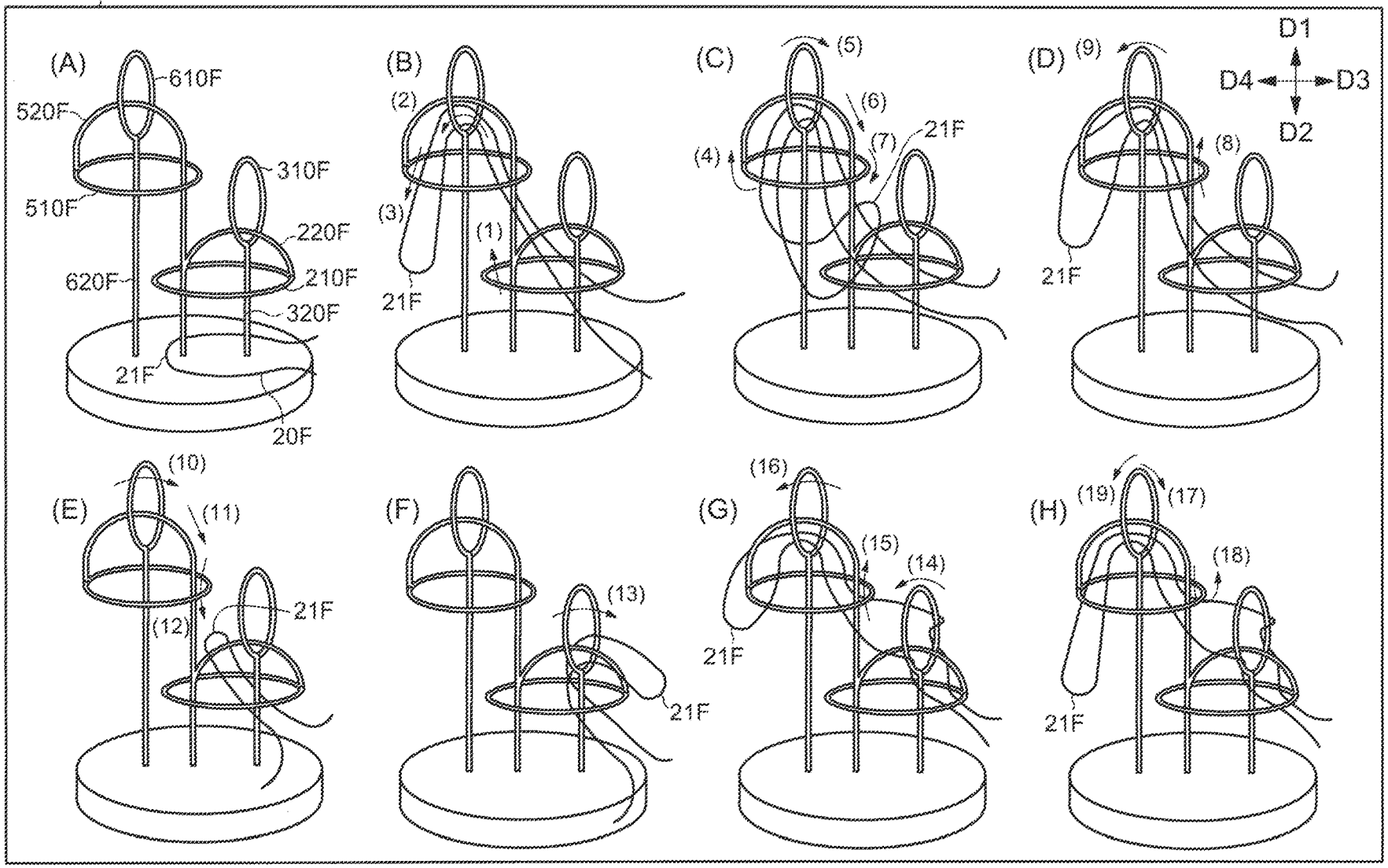
FIG. 13 is a diagram showing a method of solving a wisdom ring puzzle according to an embodiment of the present invention.

In the method of solving the wisdom ring puzzle 10F, since the method up to the state of (A) of FIG. 13 is the same as that of (A) of FIG. 2 to (D) of FIG. 2, description thereof will be omitted. Also, the first structure body 200 in FIG. 2 corresponds to the fourth structure body 500F in FIG. 12, the second structure body 300 in FIG. 2 corresponds to the fourth structure body 600F in FIG. 12, and the third structure body 400 in FIG. 2 corresponds to the first structure body 200F and the second structure body 300F in FIG. 12. The state of (A) of FIG. 13 is a state in which the lace 20F is entangled with the first pole 220F (the third pole 520F) and the second pole 320F.

As shown in (B) of FIG. 13, the tip 21F of the lace 20F passes through the inner side of the first ring unit 210F in the direction D1 (1), moves in the direction D1 along the third pole 520F, passes through the inner side of the fourth ring unit 610F in the direction D4 (2), and passes through the inner side of the third ring unit 510F in the direction D2 (3). That is, the lace 20F hangs on the inner side of the fourth ring unit 610F and hangs down in the direction D2 so as to pass through the inner side of the third ring unit 510F.

As shown in (C) of FIG. 13, the tip 21F of the lace 20F crosses over the outer side (direction D2 side) of the third ring unit 510F while maintaining a state in which the lace 20 sandwiches the third ring unit 510F (4), moves in the direction D1 along the third pole 520F, crosses over the fourth ring unit 601F in the direction D3 (5), moves in the direction D2 along the third pole 520F (6), and crosses over the outer side (direction D3 side) of the third ring unit 510F (7). In this case, the tip 21F of the lace 20F is in a state where it can be caught at a branch point between the third pole 520F and the first pole 220F.

As shown in (D) of FIG. 13, the tip 21F of the lace 20F passes through the inner side of the third ring unit 510F in the direction D1 (8), crosses over the fourth ring unit 610F in the direction D4 (9), and moves in the direction D2 along the third pole 520F. In this state, the lace 20F in the vicinity of the tip 21F is positioned at the outer side of the third ring unit 510F.

As shown in (E) of FIG. 13, the tip 21F of the lace 20F moves in the direction D1 along the third pole 520F, passes through the inner side of the fourth ring unit 610F in the direction D3 (10), moves in the direction D2 along the third pole 520F (11), and passes through the inner side of the third ring unit 510F in the direction D2 (12). In this case, the tip 21F of the lace 20F is in a state where it can be caught at the branch point between the third pole 520F and the first pole 220F. In this state, the lace 20F sandwiches the first pole 220F and the second pole 320F.

As shown in (F) of FIG. 13, the tip 21F of the lace 20F passes through the inner side of the second ring unit 310F in the direction D3 (13). In this state, the lace 20F sandwiches the first pole 220F and the first pole 220F.

As shown in (G) of FIG. 13, the tip 21F of the lace 20F crosses over the second ring unit 310F in the direction D4 (14), passes through the inner side of the third ring unit 510F in the direction D1 (15), moves in the direction D1 along the third pole 520F, and passes through the inner side of the fourth ring unit 610F in the direction D4. In this state, the lace 20F in the vicinity of the tip 21F is positioned at the outer side of the third ring unit 510F.

As shown in (H) of FIG. 13, the tip 21F of the lace 20F crosses over the fourth ring unit 610F in the direction D3 (17). Thereafter, the tip 21F moves in the direction D2 along the third pole 520F, passes through the inner side of the third ring unit 510F in the direction D2 (18), turns and crosses over the outer side (direction D3 side) of the third ring unit 510F in the direction D1 (18). Then, the tip 21F crosses over the fourth ring unit 610F in the direction D4 (18). In this state, the lace 20F hangs on the inner side of the fourth ring unit 610F and hangs down in the direction D2 so as to pass through the inner side of the third ring unit 510F.

Figure 14:
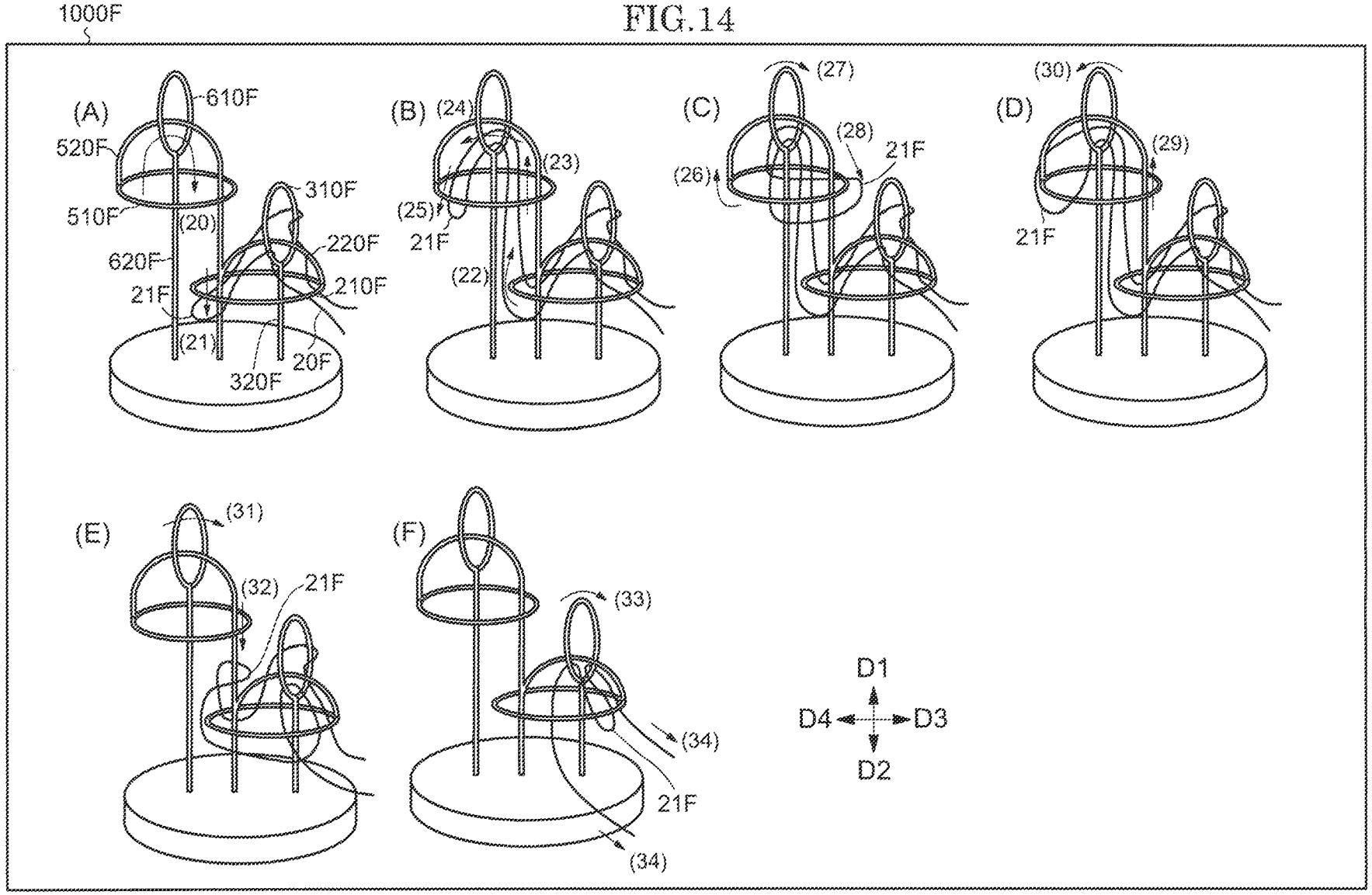
FIG. 14 is a diagram showing a method of solving a wisdom ring puzzle according to an embodiment of the present invention.

As shown in (A) of FIG. 14, the tip 21F of the lace 20F passes through the inner side of the third ring unit 510F in the direction D1, passes through the inner side of the fourth ring unit 610F in the direction D3, and passes through the inner side of the third ring unit 510F in the direction D2 (20). Thereafter, the tip 21F moves in the direction D2 along the third pole 520F and passes through the inner side of the first ring unit 210F in the direction D2 (21).

As shown in (B) of FIG. 14, the tip 21F of the lace 20F crosses over the outer side (direction D4 side) of the first ring unit 210F in the direction D1 (22), moves in the direction D1 along the third pole 520F and the fourth pole 620F, passes through the inner side of the third ring unit 510F in the direction D1 (23), passes through the inner side of the fourth ring unit 610F in the direction D4 (24), moves in the direction D2 along the fourth pole 620F, and passes through the inner side of the third ring unit 510F in the direction D2 (25). In this state, the lace 20F hangs on the inner side of the fourth ring unit 610F and hangs down in the direction D2 so as to pass through the inner side of the third ring unit 510F.

As shown in (C) of FIG. 14, the tip 21F of the lace 20F crosses over the outer side (direction D4 side) of the third ring unit 510F in the direction D1 (26), moves in the direction D1 along the third pole 520F, crosses over the fourth ring unit 610F in the direction D3 (27), moves in the direction D2 along the third pole 520F, and crosses over the outer side (direction D3 side) of the third ring unit 510F in the direction D2 (28).

As shown in (D) of FIG. 14, the tip 21F of the lace 20F passes through the inner side of the third ring unit 510F in the direction D1 (29) and crosses over the fourth ring unit 610F in the direction D4 (30).

As shown in (E) of FIG. 14, the tip 21F of the lace 20F moves in the direction D1 along the third pole 520F, passes through the inner side of the fourth ring unit 610F in the direction D3 (31), moves in the direction D2 along the third pole 520F, and passes through the inner side of the third ring unit 510F in the direction D2 (32).

As shown in (F) of FIG. 14, the tip 21F of the lace 20F crosses over the second ring unit 310F in the direction D3 (33). When the lace 20F extending from the tip 21F is pulled in this state (34), the lace 20F is in a state of being entangled only with the second pole 320F (a state in which the puzzle is solved). In this state, only the second pole 320F exists at the inner side of the lace 20F.

[4-3. Method of Solving Wisdom Ring Puzzle 10F (Part 2)]

Another method 1000F of solving the wisdom ring puzzle 10F shown in FIG. 12 will be described with reference to FIG. 15 and FIG. 16. Unlike the method (Part 1) shown in FIG. 13 and FIG. 14, the method (Part 2) shown in FIG. 15 and FIG. 16 starts with the lace 20F not being entangled with any of the poles.

Figure 15:
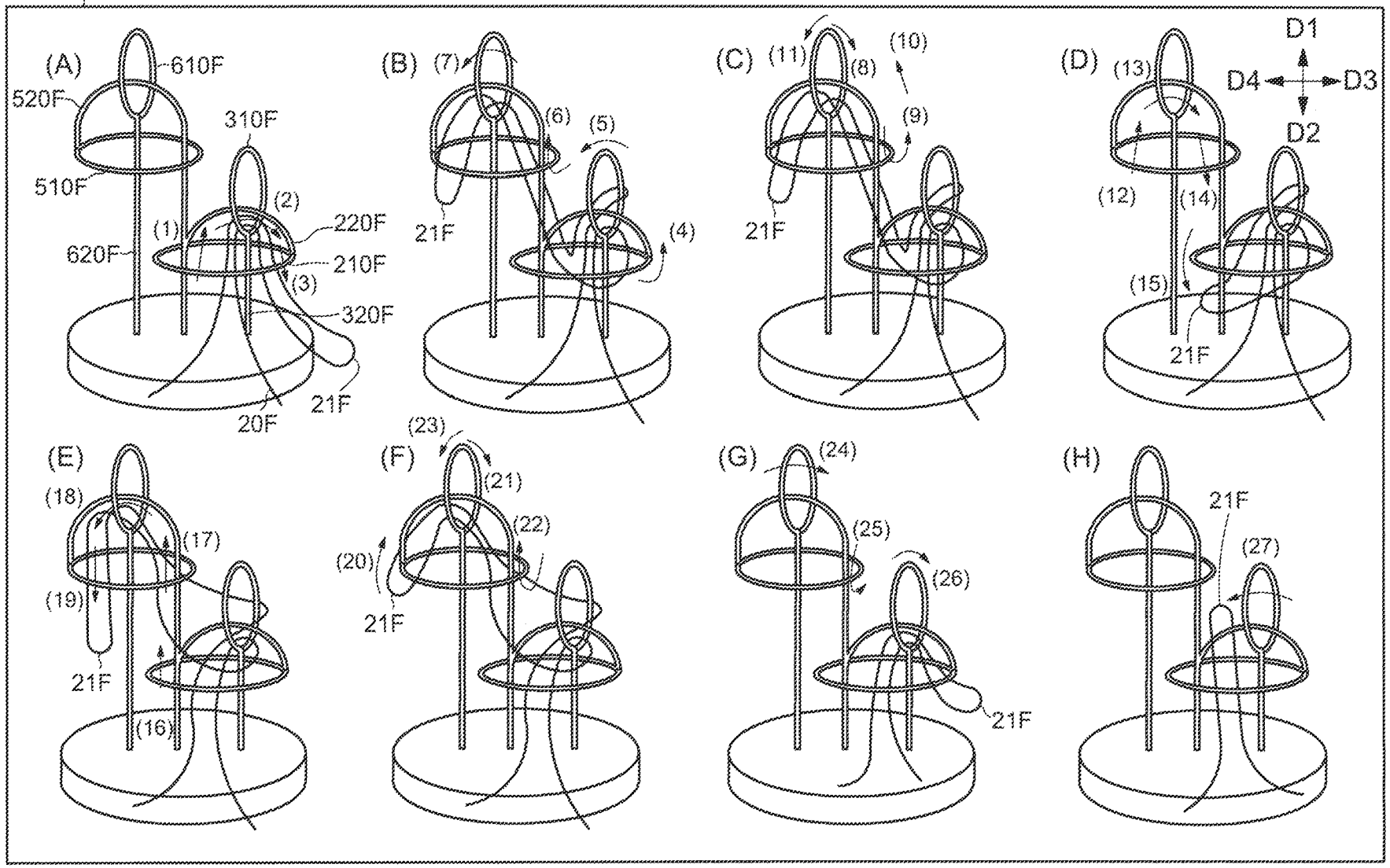
FIG. 15 is a diagram showing a method of solving a wisdom ring puzzle according to an embodiment of the present invention.

As shown in (A) of FIG. 15, the tip 21F of the lace 20F passes through the inner side of the first ring unit 210F in the direction D1 between the second pole 320F and the first pole 220F (third pole 520F) (1). Thereafter, the tip 21F moves in the direction D1 along the second pole 320F, passes through the inner side of the second ring unit 310F in the direction D3 (2), moves in the direction D2 along the second pole 320F, and passes through the inner side of the first ring unit 210F in the direction D2.

As shown in (B) of FIG. 15, the tip 21F of the lace 20F crosses over the outer side (direction D3 side) of the first ring unit 210F in the direction D1 (4), crosses over the second ring unit 310F in the direction D4 (5), passes through the inner side of the third ring unit 510F in the direction D1 (6), and passes through the inner side of the fourth ring unit 610F in the direction D4 (7). In this state, the lace 20F in the vicinity of the tip 21F is positioned at the outer side of the third ring unit 510F.

As shown in (C) of FIG. 15, the tip 21F of the lace 20F crosses over the fourth ring unit 610F in the direction D3 (8), moves in the direction D2 along the third pole 520F, passes through the inner side of the third ring unit 510F in the direction D2 (9), turns and crosses over the outer side (direction D3 side) of the third ring unit 510F in the direction D1 (9). Thereafter, the tip 21F moves in the direction D1 along the third pole 520F (10), and crosses over the fourth ring unit 610F in the direction D4 (11). In this state, the lace 20F hangs on the inner side of the fourth ring unit 610F and hangs down in the direction D2 so as to pass through the inner side of the third ring unit 510F.

As shown in (D) of FIG. 15, the tip 21F of the lace 20F passes through the inner side of the third ring unit 510F in the direction D1 (12), passes through the inner side of the fourth ring unit 610F in the direction D3 (13), passes through the inner side of the third ring unit 510F in the direction D2 (14), and crosses over the outer side (direction D4 side) of the first ring unit 210F in the direction D2.

As shown in (E) of FIG. 15, the tip 21F of the lace 20F passes through the inner side of the first ring unit 210F in the direction D1 (16), moves in the direction D1 along the third pole 520F, passes through the inner side of the third ring unit 510F in the direction D1 (17), passes through the inner side of the fourth ring unit 610F in the direction D4 (18), and passes through the inner side of the third ring unit 510F in the direction D2 (19). In this state, the lace 20F hangs on the inner side of the fourth ring unit 610F and hangs down in the direction D2 so as to pass through the inner side of the third ring unit 510F.

As shown in (F) of FIG. 15, the tip 21F of the lace 20F crosses over the outer side (direction D4 side) of the third ring unit 510F in the direction D1 (20), moves in the direction D1 along the third pole 520F, and crosses over the fourth ring unit 610F in the direction D3 (21). Thereafter, the tip 21F crosses over the outer side (direction D3 side) of the third ring unit 510F in the direction D2, turns, passes through the inner side of the third ring unit 510F in the direction D1 (22), moves in the direction D1 along the third pole 520F, and crosses over the fourth ring unit 610F in the direction D4 (23). In this state, the lace 20F in the vicinity of the tip 21F is positioned at the outer side of the third ring unit 510F. This is the difference between the state shown in (E) of FIG. 15 and the state shown in (F) of FIG. 15.

As shown in (G) of FIG. 15, the tip 21F of the lace 20F passes through the inner side of the fourth ring unit 610F in the direction D3 (24), moves in the direction D2 along the third pole 520F, passes through the inner side of the third ring unit 510F in the direction D2 (25), crosses over the second ring unit 310F in the direction D3 (26), moves in the direction D2 along the first pole 220F, and crosses over the outer side (direction D3 side) of the first ring unit 210F in the direction D2.

As shown in (H) of FIG. 15, the tip 21F of the lace 20F passes through the inner side of the second ring unit 310F in the direction D4 (27). In this state, the lace 20F passes through the inner side of the first ring unit 210F and turns so as to sandwich the first pole 220F at the side of the direction D1 of the first ring unit 210F.

Figure 16:
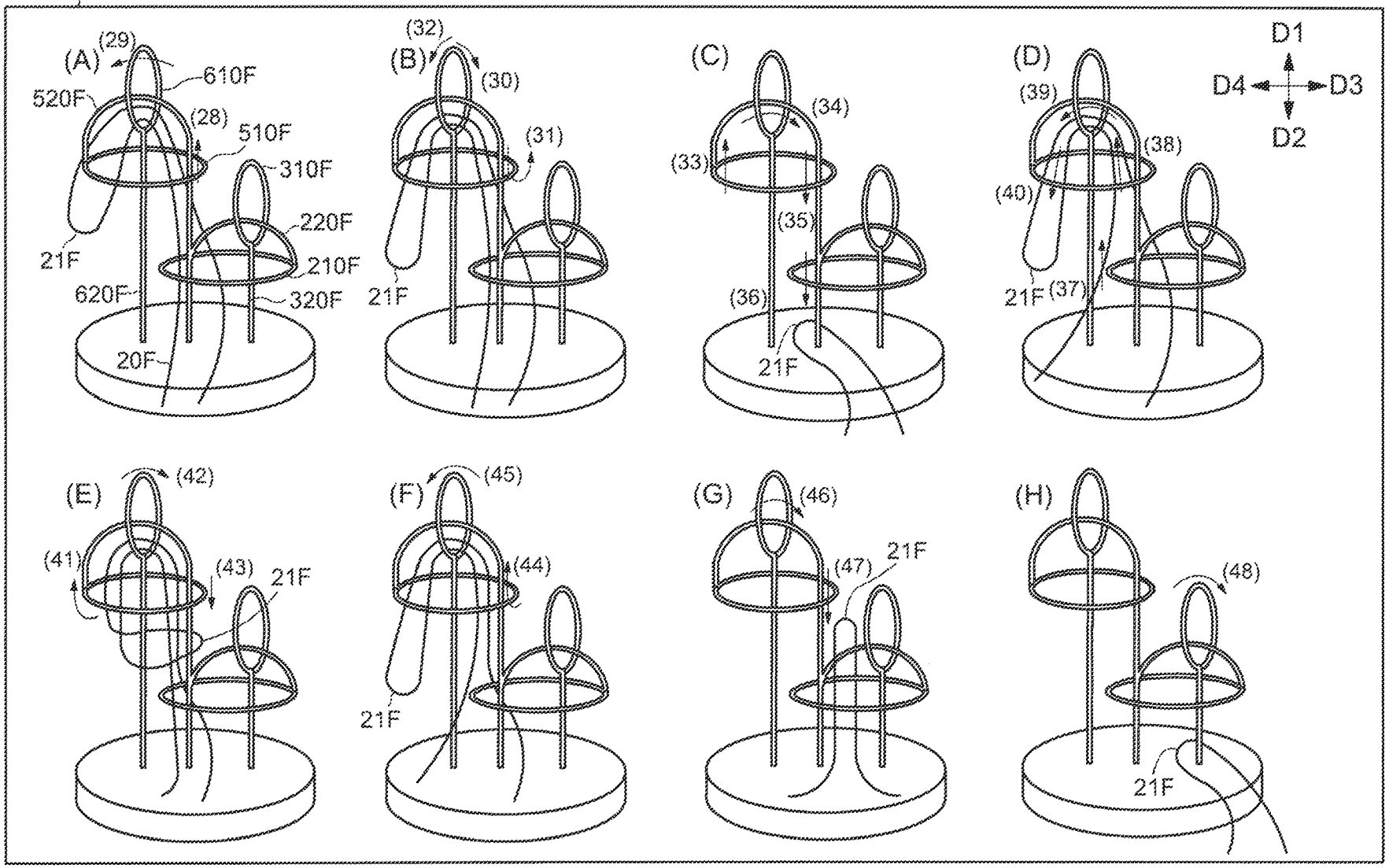
FIG. 16 is a diagram showing a method of solving a wisdom ring puzzle according to an embodiment of the present invention.

As shown in (A) of FIG. 16, the tip 21F of the lace 20F passes through the inner side of the third ring unit 510F in the direction D1 (28), moves in the direction D1 along the third pole 520F, and passes through the inner side of the fourth ring unit 610F in the direction D4 (29). In this state, the lace 20F in the vicinity of the tip 21F is positioned at the outer side of the third ring unit 510F.

As shown in (B) of FIG. 16, the tip 21F of the lace 20F crosses over the fourth ring unit 610F in the direction D3 (30). Thereafter, the tip 21F moves in the direction D2 along the third pole 520F, passes through the inner side of the third ring unit 510F in the direction D2, turns and crosses over the outer side (direction D3 side) of the third ring unit 510F in the direction D1 (31). Then, the tip 21F crosses over the fourth ring unit 610F in the direction D3 (32). In this state, the lace 20F hangs on the inner side of the fourth ring unit 610F and hangs down in the direction D2 so as to pass through the inner side of the third ring unit 510F.

As shown in (C) of FIG. 16, the tip 21F of the lace 20F passes through the inner side of the third ring unit 510F in the direction D1 (33), passes through the inner side of the fourth ring unit 610F in the direction D3 (34), moves in the direction D2 along the third pole 520F, passes through the inner side of the third ring unit 510F in the direction D2 (35), and further passes through the inner side of the first ring unit 210F in the direction D2 (36). In this state, the lace 20F is entangled only with the first pole 220F (or the first pole 220F and the third pole 520F).

As shown in (D) of FIG. 16, the tip 21F of the lace 20F crosses over the outer side (direction D4 side) of the first ring unit 210F in the direction D1 (37), moves in the direction D1 along the third ring unit 520F, passes through the inner side of the third ring unit 510F in the direction D1 (38), further moves in the direction D1 along the third ring unit 520F, passes through the inner side of the fourth ring unit 610F in the direction D4 (39), and passes through the inner side of the third ring unit 510F in the direction D2 (40).

As shown in (E) of FIG. 16, the tip 21F of the lace 20F crosses over the outer side (direction D4 side) of the third ring unit 510F in the direction D1 (41), moves in the direction D1 along the third pole 520F, crosses over the fourth ring unit 610F in the direction D3 (42), moves in the direction D2 along the third pole 520F, and crosses over the outer side (direction D3 side) of the third ring unit 510F in the direction D2 (43).

As shown in (F) of FIG. 16, the tip 21F of the lace 20F turns after crossing over the outer side of the third ring unit 510F in the direction D2, passes through the inner side of the third ring unit 510F in the direction D1 (44), further moves in the direction D1 along the third pole 520F, and crosses over the fourth ring unit 610F in the direction D4 (45). In this state, the lace 20F in the vicinity of the tip 21F is positioned at the outer side of the third ring unit 510F.

As shown in (G) of FIG. 16, the tip 21F of the lace 20F passes through the inner side of the fourth ring unit 610F in the direction D3 (46), moves in the direction D2 along the third pole 520F, and passes through the inner side of the third ring unit 510F in the direction D2 (47). Then, as shown in (H) of FIG. 16, the tip 21F crosses over the second ring unit 310F in the direction D3, so that the lace 20F is in a state of being entangled only with the second pole 320F (a state in which the puzzle is solved). In this state, only the second pole 320F exists at the inner side of the lace 20F.

5. Fifth Embodiment

Figure 17:
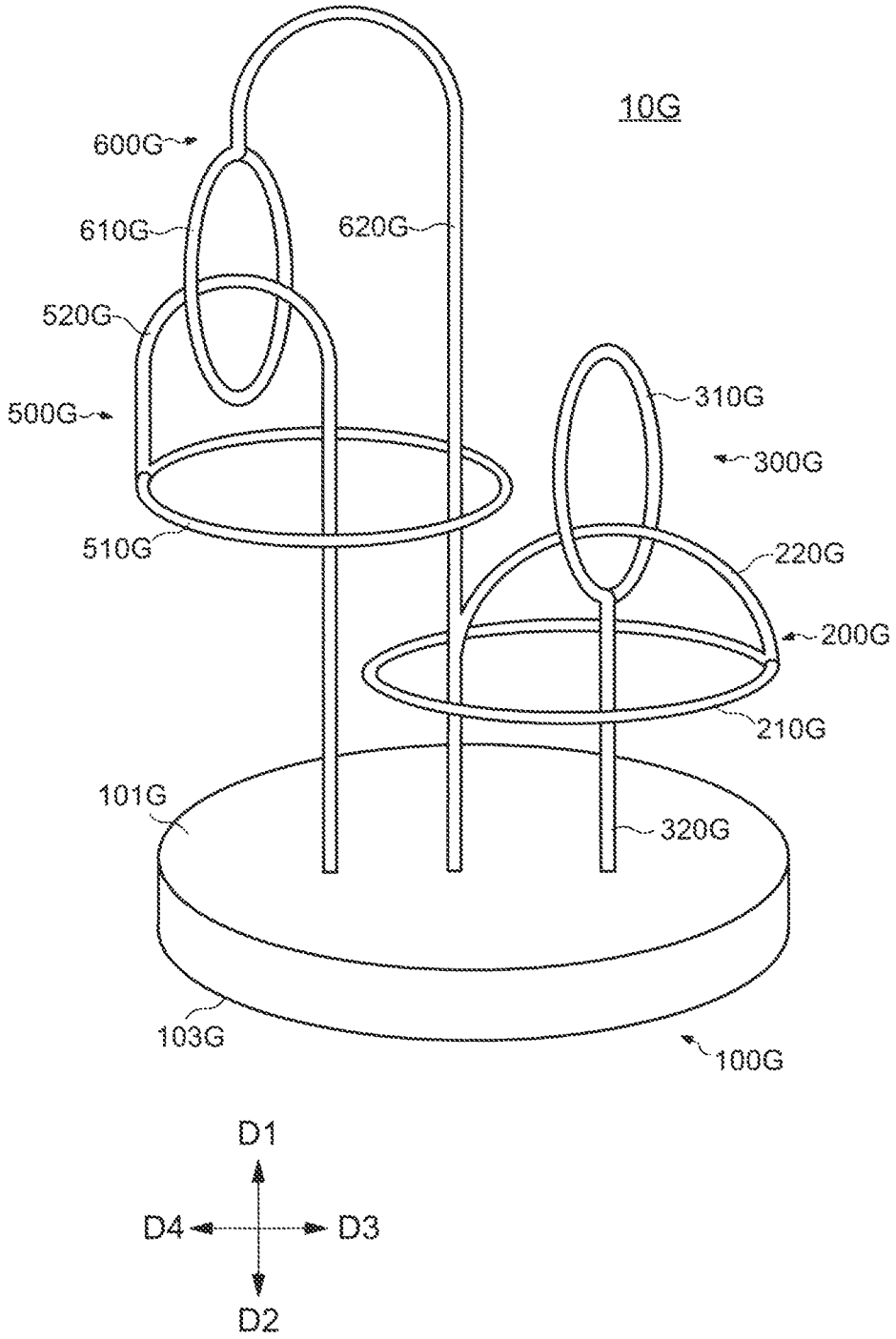
FIG. 17 is a diagram showing a structure of a wisdom ring puzzle according to an embodiment of the present invention.

A wisdom ring puzzle 10G according to a fifth embodiment will be described with reference to FIG. 17 to FIG. 21. FIG. 17 is a diagram illustrating a structure of a wisdom ring puzzle according to an embodiment of the present invention. FIG. 18 to FIG. 21 are diagrams showing a method of solving a wisdom ring puzzle according to an embodiment of the present invention. As in the first to fourth embodiments, the wisdom ring puzzle 10G is a puzzle using a lace 20G. The player enjoys the wisdom ring puzzle 20G by entangling the lace with a pole arranged on the wisdom ring puzzle 10G (for example, a second pole 320G) or removing the lace from the pole. In the following description, description of the same configuration as that of the wisdom ring puzzle 10F of the fourth embodiment will be omitted. In the following description, in the case of describing the same configuration as the wisdom ring puzzle 10F, the description may be omitted by adding the letter "G" instead of the letter "F" after the symbols shown in FIG. 12.

[5-1. Structure of Wisdom Ring Puzzle 10G]

A fourth pole 620G extends in the direction D1 from an end portion of a fourth ring unit 610G in the direction D1, turns and extends in the direction D2. The fourth pole 620G extending in the direction D2 passes through the inner side of each of a third ring unit 510G and a first ring unit 210G and reaches a stage 100G. In a plan view, the fourth pole 620G extends from a connection part with the fourth ring unit 610G toward the second pole 320G (D3) and is connected to the stage 100G at a position crossing over a third pole 520G and at a position where the third ring unit 510G and the first ring unit 210G overlap.

Although the fourth ring unit 610F is positioned at the uppermost portion in the wisdom ring puzzle 10F shown in FIG. 12, the fourth pole 620G is positioned at the uppermost portion in the wisdom ring puzzle 10G shown in FIG. 17. Further, the wisdom ring puzzle 10G of FIG. 17 is different from the wisdom ring puzzle 10F of FIG. 12 in that the fourth pole 620G (the first pole 220G) passes through each of the inner sides of the third ring unit 510G and the first ring unit 210G in the wisdom ring puzzle 10G while the third pole 520F passes through each of the inner sides of the third ring unit 510F and the first ring unit 210F in the wisdom ring puzzle 10F.

[5-2. Method of Solving Wisdom Ring Puzzle 10G (Part 1)]

A method 1000G of solving the wisdom ring puzzle 10G shown in FIG. 17 will be described with reference to FIG. 18 and FIG. 19. The wisdom ring puzzle 10G is a puzzle targeting a state in which the lace 20G is entangled only with the second pole 320G (a state in which only the second pole 320G exists at the inner side of the lace 20G).

Figure 18:
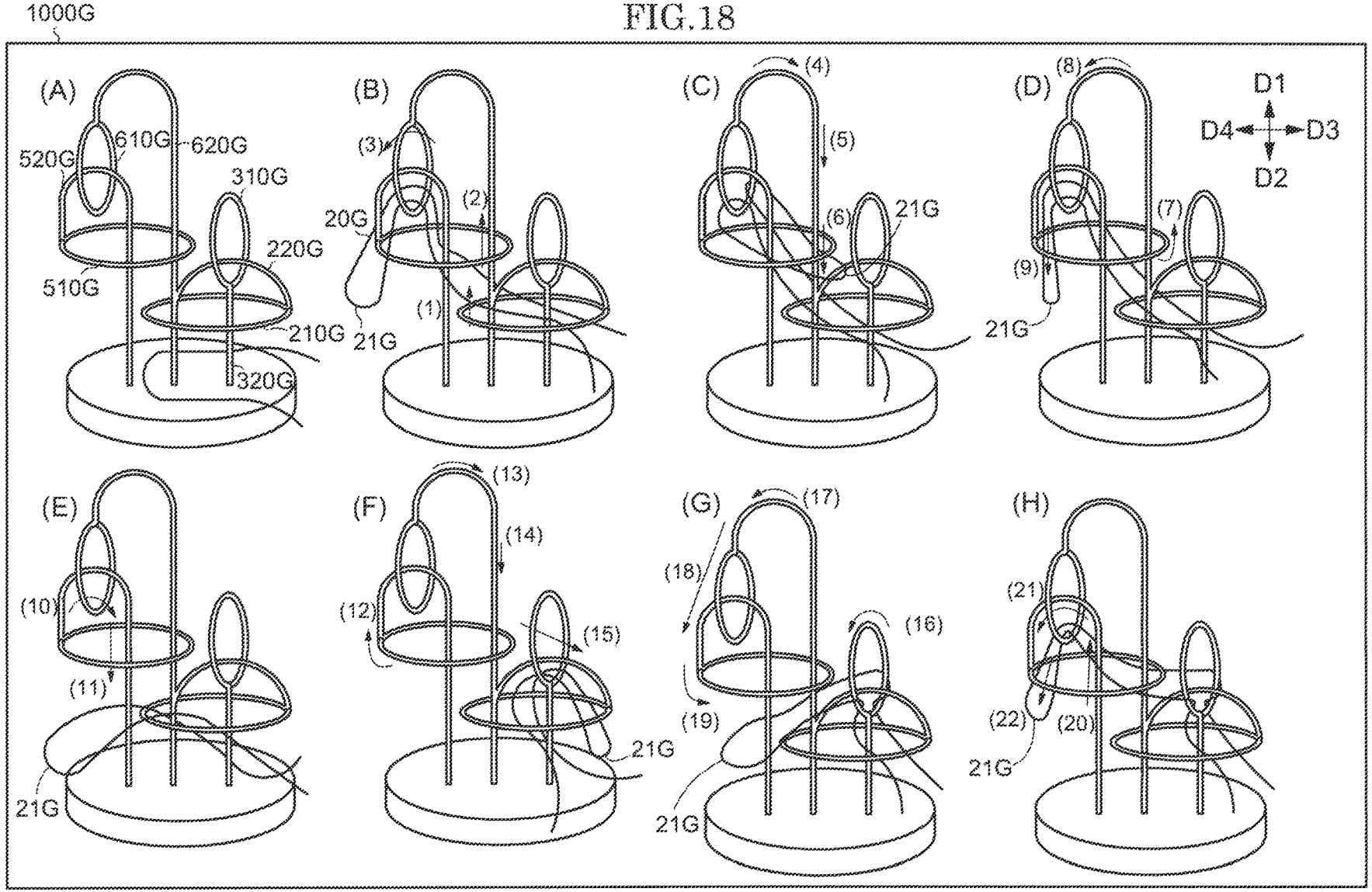
FIG. 18 is a diagram showing a method of solving a wisdom ring puzzle according to an embodiment of the present invention.

In the method of solving the wisdom ring puzzle 10G, since the method up to the state of (A) of FIG. 18 is the same as that of (A) of FIG. 4 to (D) of FIG. 4, description thereof will be omitted. Also, the first structure body 200 in FIG. 4 corresponds to a third structure 500G in FIG. 17, the second structure body 300 in FIG. 4 corresponds to a fourth structure 600G in FIG. 17, and the third structure body 400 in FIG. 4 corresponds to a first structure body 200G and a second structure body 300G in FIG. 17. The state of (A) of FIG. 18 is a state in which the lace 20G is entangled with the first pole 220G (third pole 520G) and the second pole 320G.

As shown in (B) of FIG. 18, the tip 21G of the lace 20G passes through the inner side of the first ring unit 210G in the direction D1 (1), moves in the direction D1 along the third pole 520G, passes through the inner side of the third ring unit 510G in the direction D1 (2), and passes through the inner side of the fourth ring unit 610G in the direction D4 (3). That is, the lace 20G hangs on the inner side of the fourth ring unit 610G and hangs down in the direction D2. In this case, the lace 20G in the vicinity of the tip 21G is positioned at the outer side of the third ring unit 510G.

As shown in (C) of FIG. 18, the tip 21G of the lace 20G moves in the direction D1 along the third pole 520G and the fourth pole 620G, crosses over an uppermost portion of the fourth pole 620G in the direction D3 (4), moves in the direction D2 along the fourth pole 620G (5), and passes through the inner side of the third ring unit 510G in the direction D2 (6).

As shown in (D) of FIG. 18, the tip 21G of the lace 20G crosses over the outer side (direction D3 side) of the third ring unit 510G in the direction D1 (7), moves in the direction D1 along the fourth pole 620G, crosses over the uppermost portion of the fourth pole 620G in the direction D4 (8), moves in the direction D2 along the fourth pole 620G and the third pole 520G, and passes through the inner side of the third ring unit 510G in the direction D2 (9). That is, the lace 20G hangs on the inner side of the fourth ring unit 610G and hangs down in the direction D2 so as to pass through the inner side of the third ring unit 510G.

As shown in (E) of FIG. 18, the tip 21G of the lace 20G passes through the inner side of the fourth ring unit 610G in the direction D3 (10), moves in the direction D2 along the third pole 520G, and passes through the inner side of the third ring unit 510G in the direction D2 (11).

As shown in (F) of FIG. 18, the tip 21G of the lace 20G crosses over the outer side (direction D4 side) of the third ring unit 510G in the direction D1 (12), moves in the direction D1 along the third pole 520G and the fourth pole 620G, and crosses over the uppermost portion of the fourth pole 620G in the direction D3 (13). Thereafter, the tip 21G moves in the direction D2 along the fourth pole 620G (14) and passes through the inner side of the second ring unit 310G in the direction D3 (15). In this state, the lace 20G in the vicinity of the tip 21G is positioned at the outer side of the first ring unit 210G. In addition, the lace 20G sandwiches the first pole 220G and the second pole 320G.

As shown in (G) of FIG. 18, the tip 21G of the lace 20G crosses over the second ring unit 310G in the direction D4 (16), moves in the direction D1 along the fourth pole 620G, and crosses over the uppermost portion of the fourth pole 620G in the direction D4 (17). Thereafter, the tip 21G moves 18 in the direction D2 along the fourth pole 620G and the third pole 520G (18), and crosses over the outer side (direction D4 side) of the third ring unit 510G in the direction D2 (19). In this state, the lace 20G is wound around the second ring unit 310G.

As shown in (H) of FIG. 18, the tip 21G of the lace 20G moves in the direction D1 along the third pole 520G, passes through the inner side of the third ring unit 510G in the direction D1 (20), passes through the inner side of the fourth ring unit 610G in the direction D4 (21), and passes through the inner side of the third ring unit 510G in the direction D2 (22). In this state, the lace 20G hangs on the inner side of the fourth ring unit 610G and hangs down in the direction D2 so as to pass through the inner side of the third ring unit 510G.

Figure 19:
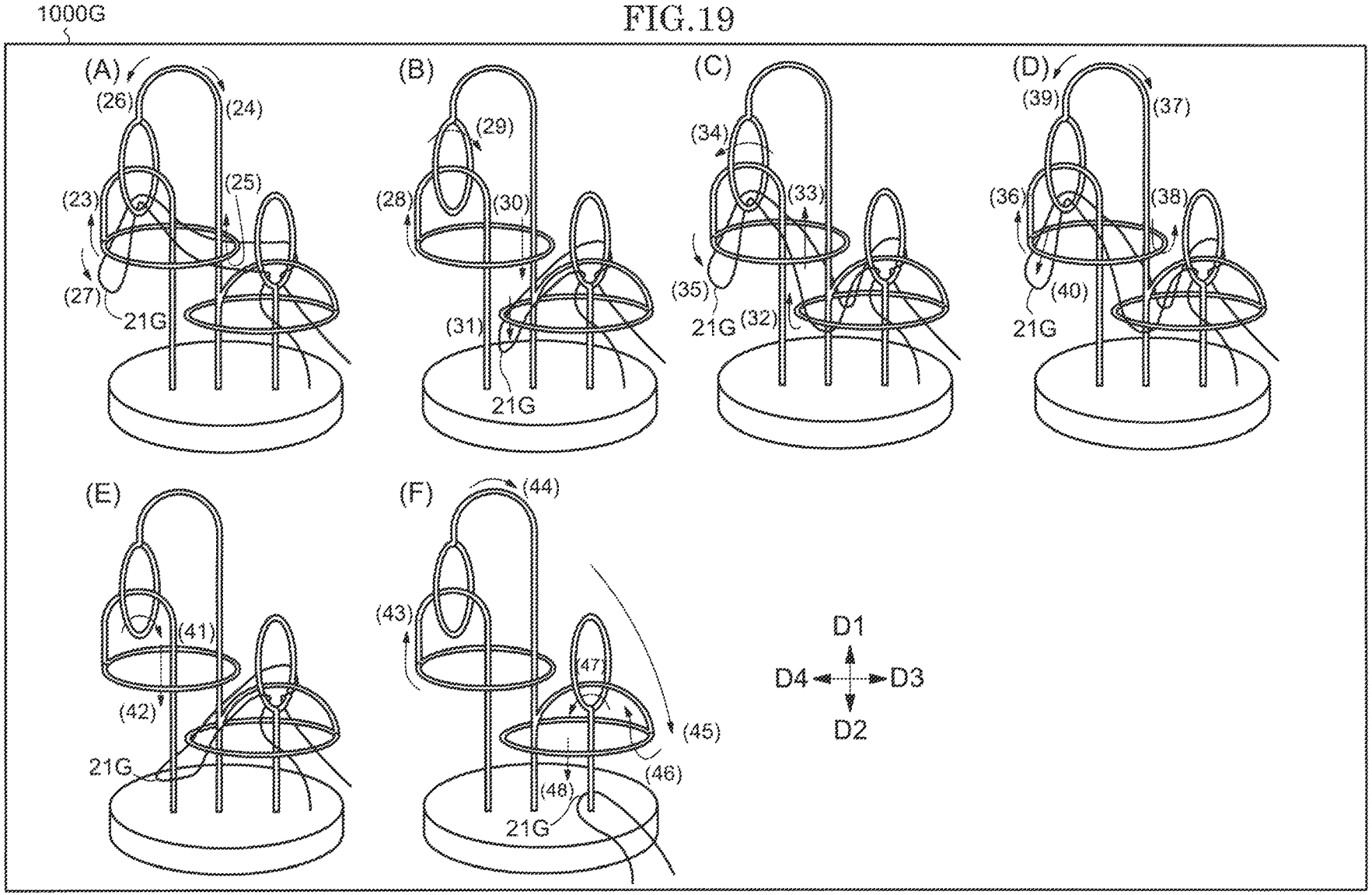
FIG. 19 is a diagram showing a method of solving a wisdom ring puzzle according to an embodiment of the present invention.

As shown in (A) of FIG. 19, the tip 21G of the lace 20G crosses over the outer side (direction D4 side) of the third ring unit 510G in the direction D1 (23), moves in the direction D1 along the third pole 520G and the fourth pole 620G, and crosses over the uppermost portion of the fourth pole 620G in the direction D3 (24). Thereafter, the tip 21G moves in the direction D2 along the fourth pole 620G, crosses over the outer side (direction D3 side) of the third ring unit 510G, turns and passes through the inner side of the third ring unit 510G in the direction D1 (25). Thereafter, the tip 21G moves in the direction D1 along the fourth pole 620G, crosses over the uppermost portion of the fourth pole 620G in the direction D4 (26), moves in the direction D2 along the fourth pole 620G and the third pole 520G, and crosses over the outer side (direction D4 side) of the third ring unit 510G in the direction D2 (27). In this state, the lace 20G hangs on the inner side of the fourth ring unit 610G, and the lace 20G in the vicinity of the tip 21G is positioned at the outer side of the third ring unit 510G.

As shown in (B) of FIG. 19, the tip 21G of the lace 20G crosses over the outer side (direction D4 side) of the third ring unit 510G in the direction D1 (28), passes through the inner side of the fourth ring unit 610G in the direction D3 (29), moves in the direction D2 along the fourth pole 620G, passes through the inner side of the third ring unit 510G in the direction D2 (30), and passes through the inner side of the first ring unit 210G in the direction D2 (31).

As shown in (C) of FIG. 19, the tip 21G of the lace 20G crosses over the outer side (direction D4 side) of the first ring unit 210G in the direction D1 (32), passes through the inner side of the third ring unit 510G in the direction D1 (33), moves in the direction D1 along the third pole 520G, passes through the inner side of the fourth ring unit 610G in the direction D4 (34), moves in the direction D2 along the third pole 520G, and crosses over the outer side (direction D4 side) of the third ring unit 510G in the direction D2 (35).

As shown in (D) of FIG. 19, the tip 21G of the lace 20G crosses over the outer side (direction D4 side) of the third ring unit 510G in the direction D1 (36), moves in the direction D1 along the third pole 520G and the fourth pole 620G, and crosses over the uppermost portion of the fourth pole 620G in the direction D3 (37). Thereafter, the tip 21G moves in the direction D2 along the fourth pole 620G, passes through the inner side of the third ring unit 510G in the direction D2, turns and crosses over the outer side (direction D3 side) of the third ring unit 510G in the direction D1 (38). Thereafter, the tip 21G moves in the direction D1 along the fourth pole 620G, crosses over the uppermost portion of the fourth pole 620G in the direction D4 (39), moves in the direction D2 along the fourth pole 620G and the third pole 520G, and passes through the inner side of the third ring unit 510G in the direction D2 (40). In this state, the lace 20G hangs on the inner side of the fourth ring unit 610G and hangs down in the direction D2 so as to pass through the inner side of the third ring unit 510G.

As shown in (E) of FIG. 19, the tip 21G of the lace 20G passes through the inner side of the third ring unit 510G in the direction D1, passes through the inner side of the fourth ring unit 610G in the direction D3 (41), moves in the direction D2 along the third pole 520G, and passes through the inner side of the third ring unit 510G in the direction D2 (42). In this state, the lace 20G passes through the inner side of the first ring unit 210G in the direction D2 and is entangled with the third pole 520G.

As shown in (F) of FIG. 19, the tip 21G of the lace 20G crosses over the outer side (direction D4 side) of the third ring unit 510G in the direction D1 (43), moves in the direction D1 along the third pole 520G and the fourth pole 620G, and crosses over the uppermost portion of the fourth pole 620G in the direction D3 (44). Thereafter, the tip 21G moves in the direction D2 along the fourth pole 620G, crosses over the second ring unit 310G in the direction D3, and crosses over the outer side (direction D3 side) of the first ring unit 210G in the direction D2 (45). Thereafter, the tip 21G turns and passes through the inner side of the first ring unit 210G in the direction D1 (46), passes through the inner side of the second ring unit 310G in the direction D4 (47), and passes through the inner side of the first ring unit 210G in the direction D2 (48), so that the lace 20G is in a state of being entangled only with the second pole 320G (a state in which the puzzle is solved). In this state, only the second pole 320G exists at the inner side of the lace 20G.

[5-3. Method of Solving Wisdom Ring Puzzle 10G (Part 2)]

Another method 1000G of solving the wisdom ring puzzle 10G shown in FIG. 17 will be described with reference to FIG. 20 and FIG. 21. Unlike the method (Part 1) shown in FIG. 18 and FIG. 19, the method (Part 2) shown in FIG. 20 and FIG. 21 starts with the lace 20G not being entangled with any of the poles.

Figure 20:
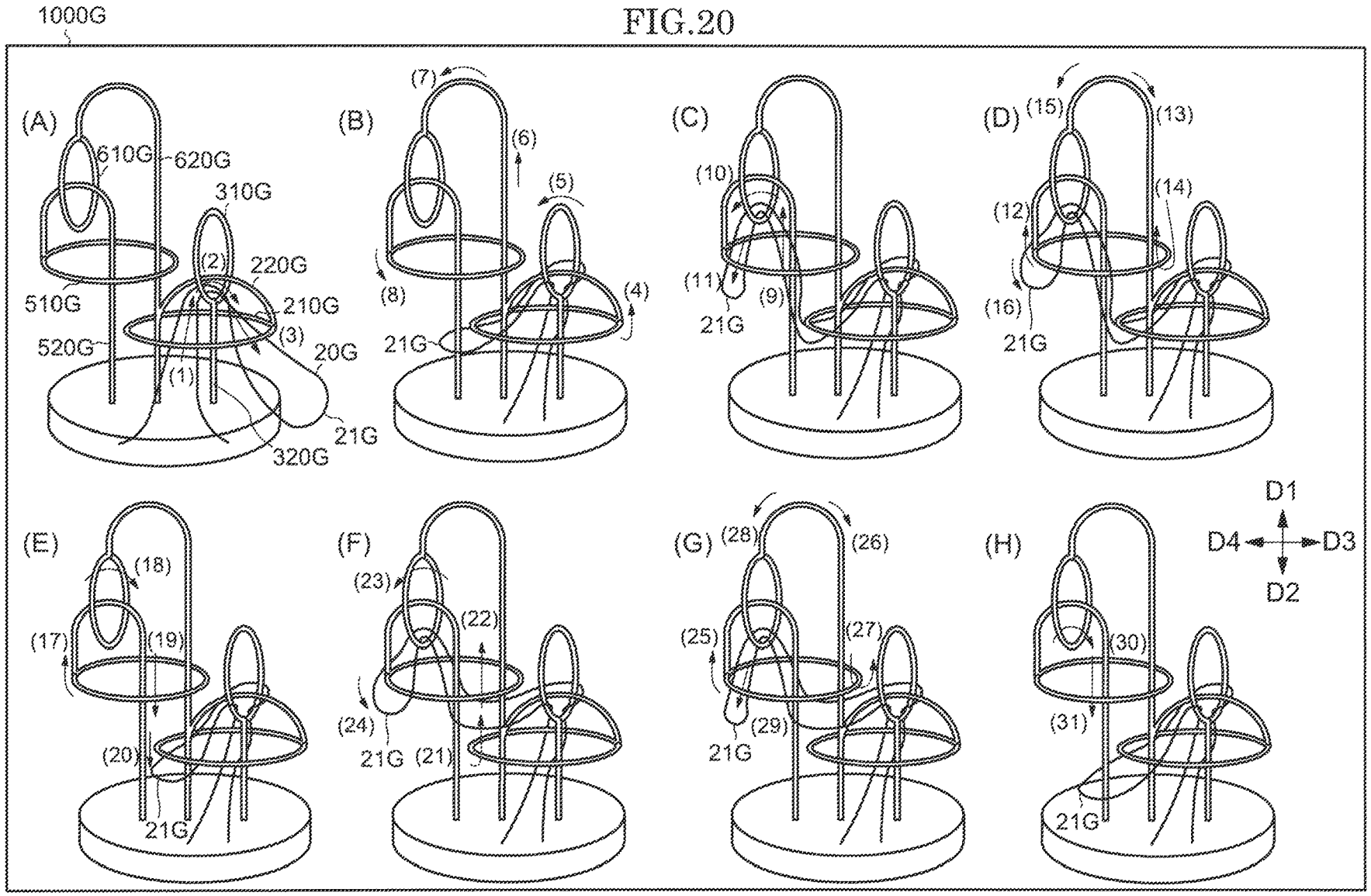
FIG. 20 is a diagram showing a method of solving a wisdom ring puzzle according to an embodiment of the present invention.

As shown in (A) of FIG. 20, the tip 21G of the lace 20G passes through the inner side of the first ring unit 210G in the direction D1 between the second pole 320G and the first pole 220G (the fourth pole 620G) (1). Thereafter, the tip 21G moves in the direction D1 along the second pole 320G, passes through the inner side of the second ring unit 310G in the direction D3 (2), moves in the direction D2 along the second pole 320G, and passes through the inner side of the first ring unit 210G in the direction D2.

As shown in (B) of FIG. 20, the tip 21G of the lace 20G crosses over the outer side (direction D3 side) of the first ring unit 210G in the direction D1 (4), crosses over the second ring unit 310G in the direction D4 (5), moves in the direction D1 along the fourth pole 620G (6), and crosses over the uppermost portion of the fourth ring unit 610G in the direction D4 (7). Thereafter, the tip 21G moves in the direction D2 along the fourth pole 620G and the third pole 520G and crosses over the outer side (direction D4 side) of the third ring unit 510G in the direction D2 (8). In this state, the lace 20G is wound around the second ring unit 310G.

As shown in (C) of FIG. 20, the tip 21G of the lace 20G moves in the direction D1 along the third pole 520G, passes through the inner side of the third ring unit 510G in the direction D1 (9), passes through the inner side of the fourth ring unit 610G in the direction D4 (10), and passes through the inner side of the third ring unit 510G in the direction D2 (11). In this state, the lace 20G hangs on the inner side of the fourth ring unit 610G and hangs down in the direction D2 so as to pass through the inner side of the third ring unit 510G.

As shown in (D) of FIG. 20, the tip 21G of the lace 20G crosses over the outer side (direction D4 side) of the third ring unit 510G in the direction D1 (12), moves in the direction D1 along the third pole 520G and the fourth pole 620G, and crosses over the uppermost portion of the fourth pole 620G in the direction D3 (13). Thereafter, the tip 21G moves in the direction D2 along the fourth pole 620G, crosses over the outer side (direction D3 side) of the third ring unit 510G in the direction D2, turns and passes through the inner side of the third ring unit 510G in the direction D1 (14). Thereafter, the tip 21G moves in the direction D1 along the fourth pole 620G, crosses over the uppermost portion of the fourth pole 620G in the direction D4 (15), moves in the direction D2 along the fourth pole 620G and the third pole 520G, moves in the direction D2 along the fourth pole 620G and the third pole 520G, and crosses over the outer side (direction D4 side) of the third ring unit 510G in the direction D2 (16). In this state, the lace 20G hangs on the inner side of the fourth ring unit 610G, and the lace 20G in the vicinity of the tip 21G is positioned at the outer side of the third ring unit 510G.

As shown in (E) of FIG. 20, the tip 21G of the lace 20G crosses over the outer side (direction D4 side) of the third ring unit 510G in the direction D1 (17), passes through the inner side of the fourth ring unit 610G in the direction D3 (18), moves in the direction D2 along the fourth pole 620G, passes through the inner side of the third ring unit 510G in the direction D2 (19), and crosses over the outer side (direction D4 side) of the first ring unit 210G in the direction D2 (20).

As shown in (F) of FIG. 20, the tip 21G of the lace 20G turns after crossing over the outer side of the first ring unit 210G in the direction D2 (21), passes through the inner side of the first ring unit 210G in the direction D1 (21), passes through the inner side of the third ring unit 510G in the direction D1 (22), moves in the direction D1 along the third pole 520G, passes through the inner side of the fourth ring unit 610G in the direction D4 (23), moves in the direction D2 along the third pole 520G, and crosses over the outer side (direction D4 side) of the third ring unit 510G in the direction D2 (24).

As shown in (G) of FIG. 20, the tip 21G of the lace 20G crosses over the outer side (direction D4 side) of the third ring unit 510G in the direction D1 (25), moves in the direction D1 along the third pole 520G and the fourth pole 620G, and crosses over the uppermost portion of the fourth pole 620G in the direction D3 (26). Thereafter, the tip 21G moves in the direction D2 along the fourth pole 620G, passes through the inner side of the third ring unit 510G in the direction D2, turns and crosses over the outer side (direction D3 side) of the third ring unit 510G in the direction D1 (27). Thereafter, the tip 21G moves in the direction D1 along the fourth pole 620G, crosses over the uppermost portion of the fourth pole 620G in the direction D4 (28), moves in the direction D2 along the fourth pole 620G and the third pole 520G, and passes through the inner side of the third ring unit 510G in the direction D2 (29). In this state, the lace 20G hangs on the inner side of the fourth ring unit 610G and hangs down in the direction D2 so as to pass through the inner side of the third ring unit 510G.

As shown in (H) of FIG. 20, the tip 21G of the lace 20G passes through the inner side of the third ring unit 510G in the direction D1, passes through the inner side of the fourth ring unit 610G in the direction D3 (30), moves in the direction D2 along the third pole 520G, and passes through the inner side of the third ring unit 510G in the direction D2 (31). In this state, the lace 20G crosses over the outer side of the first ring unit 210G and is entangled with the third pole 520G.

Figure 21:
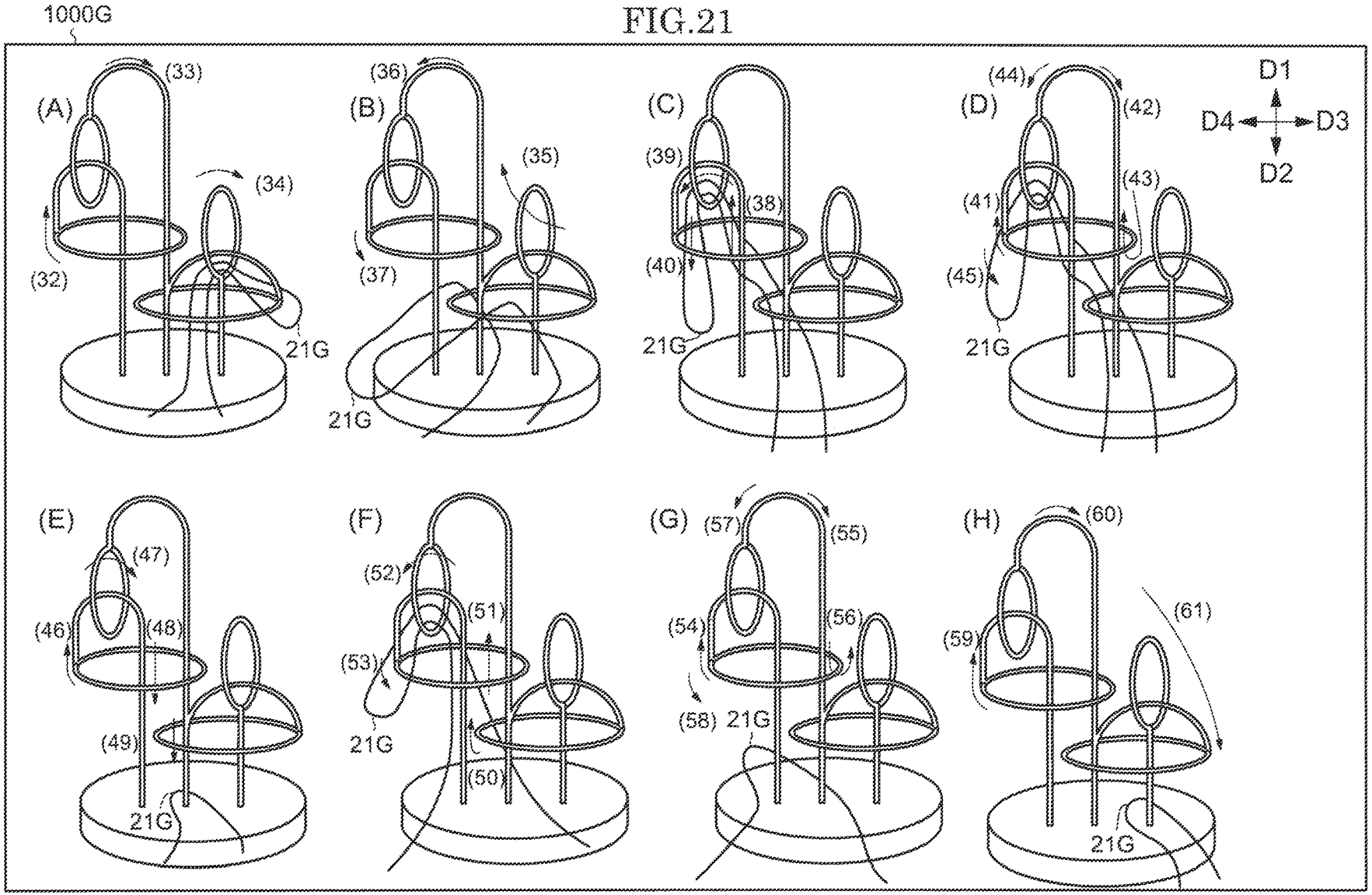
FIG. 21 is a diagram showing a method of solving a wisdom ring puzzle according to an embodiment of the present invention.

As shown in (A) of FIG. 21, the tip 21G of the lace 20G crosses over the outer side (direction D4 side) of the third ring unit 510G in the direction D1 (32), moves in the direction D1 along the third pole 520G and the fourth pole 620G, and crosses over the uppermost portion of the fourth pole 620G in the direction D3 (33). Thereafter, the tip 21G moves in the direction D2 along the fourth pole 620G and crosses over the second ring unit 310G in the direction D3 (34). In this state, the lace 20G in the vicinity of the tip 21G is positioned at the outer side of the first ring unit 210G. Further, the lace 20G sandwiches the first pole 220G.

As shown in (B) of FIG. 21, the tip 21G of the lace 20G passes through the inner side of the second ring unit 310G in the direction D4 (35), moves in the direction D1 along the fourth pole 620G, and crosses over the uppermost portion of the fourth pole 620G in the direction D4 (36). Thereafter, the tip 21G moves in the direction D2 along the fourth pole 620G and the third pole 520G and crosses over the outer side (direction D4 side) of the third ring unit 510G in the direction D2 (37).

As shown in (C) of FIG. 21, the tip 21G of the lace 20G moves in the direction D1 along the third pole 520G, passes through the inner side of the third ring unit 510G in the direction D1 (38), passes through the inner side of the fourth ring unit 610G in the direction D4 (39), and passes through the inner side of the third ring unit 510G in the direction D2 (40). In this state, the lace 20G hangs on the inner side of the fourth ring unit 610G and hangs down in the direction D2 so as to pass through the inner side of the third ring unit 510G.

As shown in (D) of FIG. 21, the tip 21G of the lace 20G crosses over the outer side (direction D4 side) of the third ring unit 510G in the direction D1 (41), moves in the direction D1 along the third pole 520G and the fourth pole 620G, and crosses over the uppermost portion of the fourth pole 620G in the direction D3 (42). Thereafter, the tip 21G moves in the direction D2 along the fourth pole 620G, crosses over the outer side (direction D3 side) of the third ring unit 510G in the direction D2, turns and passes through the inner side of the third ring unit 510G in the direction D1 (43). Thereafter, the tip 21G moves in the direction D1 along the fourth pole 620G, crosses over the uppermost portion of the fourth pole 620G in the direction D4 (44), moves in the direction D2 along the fourth pole 620G and the third pole 520G, and crosses over the outer side (direction D4 side) of the third ring unit 510G in the direction D2 (45). In this state, the lace 20G hangs on the inner side of the fourth ring unit 610G, and the lace 20G in the vicinity of the tip 21G is positioned at the outer side of the third ring unit 510G.

As shown in (E) of FIG. 21, the tip 21G of the lace 20G crosses over the outer side (direction D4 side) of the third ring unit 510G in the direction D1 (46), passes through the inner side of the fourth ring unit 610G in the direction D3 (47), moves in the direction D2 along the fourth pole 620G, passes through the inner side of the third ring unit 510G in the direction D2 (48), and passes through the inner side of the first ring unit 210G in the direction D2 (49). In this state, the lace 20G is entangled only with the first pole 220G (the fourth pole 620G).

As shown in (F) of FIG. 21, the tip 21G of the lace 20G crosses over the outer side (direction D4 side) of the first ring unit 210G in the direction D1 (50), passes through the inner side of the third ring unit 510G in the direction D1 (51), moves in the direction D1 along the third pole 520G, passes through the inner side of the fourth ring unit 610G in the direction D4 (52), moves in the direction D2 along the third pole 520G, and crosses over the outer side (direction D4 side) of the third ring unit 510G in the direction D2 (53).

As shown in (G) of FIG. 21, the tip 21G of the lace 20G crosses over the outer side (direction D4 side) of the third ring unit 510G in the direction D1 (54), moves in the direction D1 along the third pole 520G and the fourth pole 620G, and crosses over the uppermost portion of the fourth pole 620G in the direction D3 (55). Thereafter, the tip 21G moves in the direction D2 along the fourth pole 620G, passes through the inner side of the third ring unit 510G in the direction D2, turns and crosses over the outer side (direction D3 side) of the third ring unit 510G in the direction D1 (56). Thereafter, the tip 21G moves in the direction D1 along the fourth pole 620G, crosses over the uppermost portion of the fourth pole 620G in the direction D4 (57), moves in the direction D2 along the fourth pole 620G and the third pole 520G, and crosses over the outer side (direction D4 side) of the third ring unit 510G in the direction D2 (58). In this state, the lace 20G is entangled with the first pole 220G (the fourth pole 620G) and the third pole 520G.

As shown in (H) of FIG. 21, the tip 21G of the lace 20G crosses over the outer side (direction D4 side) of the third ring unit 510G in the direction D1 (59), moves in the direction D1 along the third pole 520G and the fourth pole 620G, and crosses over the uppermost portion of the fourth pole 620G in the direction D3 (60). Thereafter, the tip 21G moves in the direction D2 along the fourth pole 620G, crosses over the second ring unit 310G in the direction D3, and crosses over the outer side (direction D3 side) of the first ring unit 210G in the direction D2 (61), so that the lace 20G is in a state of being entangled only with the second pole 320G (a state in which the puzzle is solved). In this state, only the second pole 320G exists at the inner side of the lace 20G.

6. Sixth Embodiment

Figure 22A:
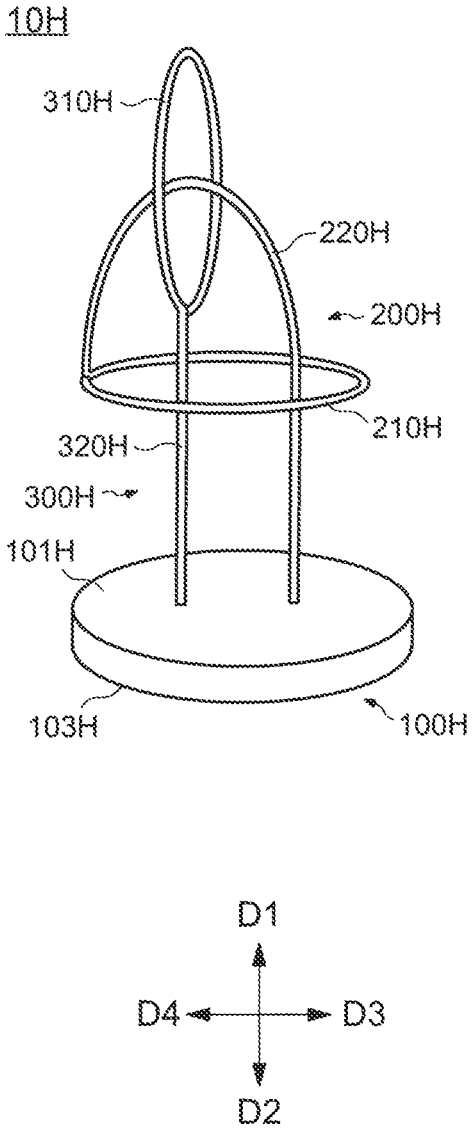
FIG. 22A is a diagram showing a structure of a wisdom ring puzzle according to an embodiment of the present invention.

Wisdom ring puzzles 10H and 10J according to the sixth embodiment will be described with reference to FIG. 22A. FIG. 22A is a diagram illustrating a structure of a wisdom ring puzzle according to an embodiment of the present invention. As in the first to fifth embodiments, the wisdom ring puzzles 10H and 10J are puzzles using laces 20H and 20J. The player enjoys the wisdom ring puzzles 10H and 10J by entangling the laces 20H and 20J with poles (for example, a first pole 220H and a second pole 320J) arranged on the wisdom ring puzzles 10H and 10J or by removing the laces 20H and 20J from the poles.

Figure 22B:
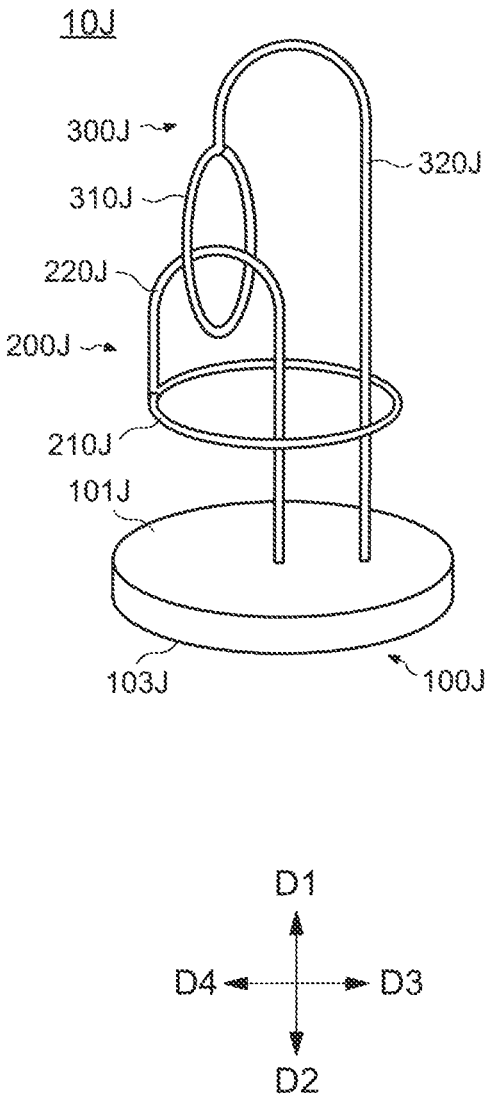
FIG. 22B is a diagram showing a structure of a wisdom ring puzzle according to an embodiment of the present invention.

The wisdom ring puzzle 10H in FIG. 22A is similar to the wisdom ring puzzle 10 in FIG. 1A, and the wisdom ring puzzle 10J in FIG. 22B is similar to the wisdom ring puzzle 10A in FIG. 1B. In the following description, the description of the configuration similar to that of the wisdom ring puzzles 10 and 10A of the first embodiment will be omitted. In the following description, in the case of describing the same configuration as that of the wisdom ring puzzle 10 among the wisdom ring puzzle 10H, the description thereof may be omitted by adding the letter "H" after the symbols shown in FIG. 1A. Further, in the case of describing the same configuration as the wisdom ring puzzle 10A among the wisdom ring puzzle 10J, the description may be omitted by adding "J" instead of the letter "A" after the symbols shown in FIG. 1B.

[6-1. Structure of Wisdom Ring Puzzle 10H]

As shown in FIG. 22A, the wisdom ring puzzle 10H includes a stage 100H, a first structure body 200H, and a second structure body 300H.

The first ring unit 210H is positioned in the direction D1 with respect to the stage 100H. The second ring unit 310H is positioned in the direction D1 with respect to the first ring unit 210H. As described above, in the present embodiment, the first virtual plane on which the first ring unit 210H is arranged is substantially parallel to an upper surface 101H, and the second virtual plane on which the second ring unit 310H is arranged is substantially orthogonal to the upper surface 101H. However, the present invention is not limited to the above configuration. For example, the angle formed by the upper surface 101H and the first virtual plane may be smaller than the angle formed by the upper surface 101H and the second virtual plane.

The first pole 220H extends from a connection part with the first ring unit 210H in the direction D1, passes through the inner side of the second ring unit 310H, passes through the inner side of the first ring unit 210H in the direction D2, and is connected to the stage 100H. In a plan view, the first pole 220H extends in the direction D3 from the connection part with the first ring unit 210H, passes through the inner side of the second ring unit 310H, and is connected to the stage 100H at the inner side of the first ring unit 210H. The second pole 320H extends from the second ring unit 310H in the direction D2, passes through the inner side of the first ring unit 210H, and is connected to the stage 100H.

[6-2. Structure of Wisdom Ring Puzzle 10J]

As shown in FIG. 22B, the wisdom ring puzzle 10J includes a stage 100J, a first structure body 200J, and a second structure body 300J.

The second pole 320J extends in the direction D1 from an end portion of the second ring unit 310J in the direction D1, turns and extends in the direction D2. The second pole 320J extending in the direction D2 passes through the inner side of the first ring unit 210J and reaches the stage 100J. In a plan view, the second pole 320J extends in the direction D3 from a connection part with the second ring unit 310J and is connected to the stage 100J at a position crossing over the first pole 220J and at the inner side of the first ring unit 210J.

The wisdom ring puzzle 10H shown in FIG. 22A corresponds to a configuration in which the third structure body 400 is omitted from the wisdom ring puzzle 10 shown in FIG. 1A. The wisdom ring puzzle 10J shown in FIG. 22B corresponds to a configuration in which the third structure body 400A is omitted from the wisdom ring puzzle 10A of FIG. 1B.

[6-3. Method of Solving Wisdom Ring Puzzle 10H]

A method of solving the wisdom ring puzzle 10H shown in FIG. 22A is similar to the method of solving the wisdom ring puzzle 10 shown in FIG. 1A. For example, the wisdom ring puzzle 10H can be solved in the same manner as in (A) of FIG. 2 to (D) of FIG. 2, or in the same manner as in (A) of FIG. 3 to (D) of FIG. 3.

[6-4. Method of Solving Wisdom Ring Puzzle 10J]

The method of solving the wisdom ring puzzle 10J shown in FIG. 22B is similar to the method of solving the wisdom ring puzzle 10A shown in FIG. 1B. For example, the wisdom ring puzzle 10J can be solved in the same manner as in (A) of FIG. 4 to (D) of FIG. 4, or in the same manner as in (A) of FIG. 5 to (E) of FIG. 5.

7. Comparative Example (Structure which does not Work as Wisdom Ring Puzzle)

Figure 23:
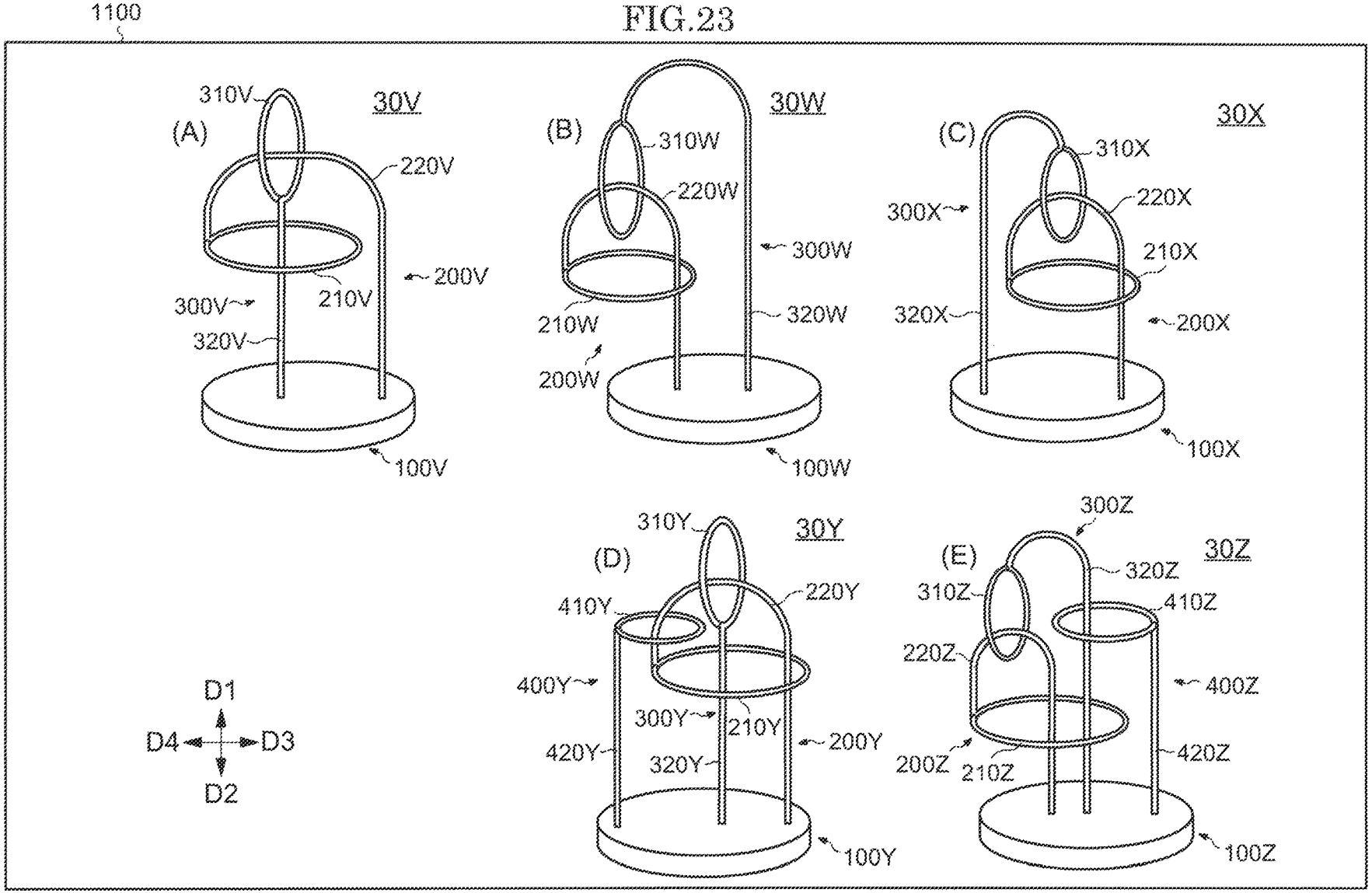
FIG. 23 is a diagram showing a structure of a wisdom ring puzzle in a comparative example.

A comparative example 1100 with respect to the present embodiment will be described with reference to FIG. 23. FIG. 23 is a diagram showing a structure of a wisdom ring puzzle in a comparative example. Although the configuration shown as a comparative example in FIG. 23 is similar to the configurations of the first to sixth embodiments described above, the configuration does not work as a wisdom ring puzzle.

Although a structure body 30V shown in (A) of FIG. 23 is similar to the wisdom ring puzzle 10H of FIG. 22A, it is different from the wisdom ring puzzle 10H in that a first pole 220V is connected to a stage 100V crossing over the outer side of a first ring unit 210V without passing through the inner side of the first ring unit 210V. The structure body 30V does not work as a wisdom ring puzzle because a sealed space is formed by a first structure body 200V and a second structure body 300V.

Although structure bodies 30W and 30X shown in (B) of FIG. 23 and (C) of FIG. 23 are similar to the wisdom ring puzzle 10J of FIG. 22B, they are different from the wisdom ring puzzle 10J in that second poles 320W and 320X cross over the outer side of the first ring unit 210 and are connected to stages 100W and 100X without passing through the inner side of first ring units 210W and 210X. The structure bodies 30W and 30X do not work as a wisdom ring puzzle because a sealed space is formed by first structure bodies 200W and 200X and second structure bodies 300W and 300X.

Although a structure body 30Y shown in (D) of FIG. 23 is similar to the wisdom ring puzzle 10 of FIG. 1A, it is different from the wisdom ring puzzle 10 in that a member passing through the inner side of a third ring unit 410Y is not a first pole 220Y between a first ring 210Y and a stage 100Y but the first pole 220Y between a connection part between the first ring unit 210Y and the first pole 220Y and second ring unit 310Y. The structure body 30Y does not work as a wisdom ring puzzle because a sealed space is formed by a first structure body 200Y, a second structure body 300Y, and a third structure body 400Y.

Although a structure body 30Z shown in (E) of FIG. 23 is similar to the wisdom ring puzzle 10A of FIG. 1B, it is different from the wisdom ring puzzle 10A in that a member passing through the inner side of a third ring unit 410Z is not a first pole 220Z between a first ring 210Z and a stage 100Z but the first pole 220Z between a connection part between a second ring 310Z and a second pole 320Z and the first ring 220Z. The structure body 30Z does not work as a wisdom ring puzzle because a sealed space is formed by a first structure body 200Z, a second structure body 300Z, and a third structure body 400Z.

The method of solving the wisdom ring puzzle shown in the above-described embodiment is merely an example, and there are various methods other than the above.

Each of the embodiments described above as the embodiment of the present invention can be appropriately combined as long as no contradiction is caused. Further, the addition, deletion, or design change of components, or the addition, deletion, or condition change of process as appropriate by those skilled in the art based on each embodiment are also included in the scope of the present invention as long as they are provided with the gist of the present invention.

Further, it is understood that, even if the effect is different from those provided by each of the above-described embodiments, the effect obvious from the description in the specification or easily predicted by persons ordinarily skilled in the art is apparently derived from the present invention.

According to an embodiment of the present invention, it is possible to provide a wisdom ring puzzle capable of sustaining the interest and motivation of a player to create a solution.

What is claimed is:

1. A wisdom ring puzzle comprising:

a stage;

a first ring unit positioned in a first direction with respect to the stage;

a second ring unit positioned in the first direction with respect to the first ring unit;

a first pole connected to the first ring unit, extending in the first direction from the first ring unit, turning and extending in a second direction opposite to the first direction, connected to the stage passing through the inner side of the first ring unit, and passing through the inner side of the second ring unit at a side of the first direction of the first ring unit; and a second pole connected to the second ring unit and connected to the stage through the inner side of the first ring unit.

2. The wisdom ring puzzle according to claim 1, wherein the second pole extends toward the stage from an end portion of the second ring unit in the second direction, and the second pole is connected to the stage.

3. The wisdom ring puzzle according to claim 2, further comprising:

a third ring unit positioned between the stage and the first ring unit; and a third pole connected to the third ring unit and connected to the stage, wherein the first pole is connected to the stage through the inner side of the third ring unit.

4. The wisdom ring puzzle according to claim 1, further comprising:

a third ring unit positioned in the first direction with respect to the first ring unit;

a fourth ring unit positioned in the first direction with respect to the third ring unit;

a third pole connected to the third ring unit, extending in the first direction from the third ring unit, turning and extending in the second direction, and passing through the inner side of the third ring unit and the inner side of the first ring unit; and a fourth pole connected to the fourth ring unit and connected to the stage through the inner side of the third ring unit, wherein the first pole passes through the inner side of the second ring unit, and the third pole passes through the inner side of the fourth ring unit.

5. The wisdom ring puzzle according to claim 1, further comprising:

a third ring unit positioned in the first direction with respect to the first ring unit;

a fourth ring unit positioned in the first direction with respect to the third ring unit;

a third pole connected to the third ring unit, extending in the first direction from the third ring unit, turning and extending in the second direction, and passing through the inner side of the third ring unit; and a fourth pole connected to the fourth ring unit, extending in the first direction from the fourth ring unit, turning and extending in the second direction, and connected to the stage through the inner side of the third ring unit and the inner side of the first ring unit, wherein the first pole passes through the inner side of the second ring unit, and the third pole passes through the inner side of the fourth ring unit.

6. The wisdom ring puzzle according to claim 1, wherein the second pole extends in the first direction from an end portion of the second ring unit in the first direction, turns and extends in the second direction, and is connected to the stage through the inner side of the first ring unit.

7. The wisdom ring puzzle according to claim 6, further comprising:

a third ring unit positioned between the stage and the first ring unit; and a third pole connected to the third ring unit and connected to the stage, wherein the second pole is connected to the stage through the inner side of the third ring unit.

* * * * *